US010403980B2

(12) United States Patent
Ardavan et al.

(10) Patent No.: US 10,403,980 B2
(45) Date of Patent: Sep. 3, 2019

(54) POLARIZATION CURRENT ANTENNAS THAT GENERATE SUPERLUMINAL POLARIZATION CURRENT WAVES HAVING ACCELERATION AND RELATED METHODS OF EXCITING SUCH ANTENNAS

(71) Applicants: Arzhang Ardavan, Oxford (GB); Houshang Ardavan, Cambridge (GB)

(72) Inventors: Arzhang Ardavan, Oxford (GB); Houshang Ardavan, Cambridge (GB)

(73) Assignee: Oxbridge Pulsar Sources Ltd., Cambridge (GB)

( * ) Notice: Subject to any disclaimer, the term of this patent is extended or adjusted under 35 U.S.C. 154(b) by 178 days.

(21) Appl. No.: 15/458,323

(22) Filed: Mar. 14, 2017

(65) Prior Publication Data

US 2017/0271778 A1 Sep. 21, 2017

Related U.S. Application Data

(60) Provisional application No. 62/309,584, filed on Mar. 17, 2016.

(51) Int. Cl.
*H01Q 13/00* (2006.01)
*H01Q 13/24* (2006.01)
(Continued)

(52) U.S. Cl.
CPC ..... *H01Q 13/24* (2013.01); *H01Q 3/30* (2013.01); *H01Q 3/34* (2013.01); *H01Q 3/44* (2013.01);
(Continued)

(58) Field of Classification Search
None
See application file for complete search history.

(56) References Cited

U.S. PATENT DOCUMENTS 9,287,632 B2 * 3/2016 Manry, Jr. ..... H01Q 21/061
9,548,536 B2 * 1/2017 Ardavan ..... H01Q 3/30
(Continued)

FOREIGN PATENT DOCUMENTS

EP 1 112 578 B1 12/2010
WO WO 2014/100008 A1 6/2014

OTHER PUBLICATIONS

H. Ardavan "Frequency Spectrum of Focused Broadband Pulses of Electromagnetic Radiation Generated by Polarization Currents with Superluminally Rotating Distribution Patterns," arXiv: Physics/0211088v1 [physics.optics], Nov. 19, 2002, pp. 1-26.*
(Continued)

*Primary Examiner* — Trinh V Dinh
(74) *Attorney, Agent, or Firm* — Myers Bigel, P.A.

(57) ABSTRACT

Polarization current antennas comprise a dielectric radiator that extends along a z-axis, polarization devices that are positioned adjacent the dielectric radiator along the z-axis that are configured to polarize respective portions of the dielectric radiator and a feed network that is configured to excite the polarization devices with an RF signal to generate a polarization current wave that propagates in the z-axis direction through the dielectric radiator, with acceleration, at (1) a first variable speed that does not decrease as the wave moves along a first portion of the dielectric radiator and that does not increase as the wave moves along the remainder of the dielectric radiator, (2) a second variable speed that does not decrease as the wave moves along the entirety of the dielectric radiator or (3) a third variable speed that does not increase as the wave moves along the entirety of the dielectric radiator.

22 Claims, 9 Drawing Sheets

(51) Int. Cl.

| | |
|---|---|
| ***H01Q 3/34*** | (2006.01) |
| ***H01Q 3/30*** | (2006.01) |
| ***H01Q 3/44*** | (2006.01) |
| ***H01Q 13/28*** | (2006.01) |
| ***H01Q 21/00*** | (2006.01) |

(52) U.S. Cl.
CPC ..... *H01Q 13/28* (2013.01); *H01Q 21/0075* (2013.01)

(56) References Cited

U.S. PATENT DOCUMENTS

| | | | | |
|---|---|---|---|---|
| 2006/0192504 | A1* | 8/2006 | Ardavan | G21K 1/16 315/503 |
| 2010/0039324 | A1 | 2/2010 | Singleton et al. | |
| 2014/0152510 | A1* | 6/2014 | Manry, Jr. | H01Q 21/061 343/700 MS |
| 2015/0062273 | A1* | 3/2015 | Ando | B41J 11/0045 347/104 |
| 2015/0325914 | A1* | 11/2015 | Ardavan | H01Q 3/30 343/850 |
| 2017/0271778 | A1* | 9/2017 | Ardavan | H01Q 3/34 |

OTHER PUBLICATIONS

Notification of Transmittal of the International Search Report and the Written Opinion of the International Searching Authority, or the Declaration, International Application No. PCT/GB2017/050702, dated Jun. 14, 2017, 23 pages.

H. Ardavan, "Generation of Focused, Nonspherically Decaying Pulses of Electromagnetic Radiation," The American Physical Society, Physical Review, vol. 58, No. 5, Nov. 1998, pp. 6659-6684.

Houshang Ardavan et al., "Frequency Spectrum of Focused Broadband Pulses of Electromagnetic Radiation Generated by Polarization Currents with Superluminally Rotating Distribution Patterns," Optical Society of America, vol. 20, No. 11, Nov. 2003, pp. 2137-2155.

Houshang Ardavan et al., "Spectral and Polarization Characteristics of the Nonspherically Decaying Radiation Generated by Polarization Currents with Superluminally Rotating Distribution Patterns," Optical Society of America, vol. 21, No. 5, May 2004, pp. 858-872.

Houshang Ardavan et al., "Morphology of the Nonspherically Decaying Radiation Beam Generated by a Rotating Superluminal Source," Optical Society of America, vol. 24, No. 8, Aug. 2007, pp. 2443-2456.

Houshang Ardavan et al., "Fundamental Role of the Retarded Potential in the Electrodynamics of Superluminal Sources," Optical Society of America, vol. 25, No. 3, Mar. 2008 p. 543-557.

A. Ardavan et al., Corrected Article: "Experimental Observation of Nonspherically-Decaying Radiation from a Rotating Superluminal Source," Journal of Applied Physics, vol. 96, No. 12, Dec. 15, 2004, pp. 7760-7777.

Houshang Ardavan et al., "Inadequacies in the Conventional Treatment of the Radiation Field of Moving Sources," Journal of Mathematical Physics 50, 103510 (2009).

B. M. Bolotovskii, et al., "Radiation of Superluminal Sources in Empty Space," Russian Academy of Science, 48(9), 2005 (pp. 903-915.

Houshang Ardavan et al. "The Frequency Spectrum of Focused Broadband Pulses of Electromagnetic Radiation Generated by Polarization Currents with Superluminally Rotating Distribution Patterns" arxiv.org, Cornell University Library, 201 OLIN Library Cornell University, Ithaca NY 14852 (Nov. 20, 2002), 26 pages.

Houshang Ardavan et al. "Morphology of the Nonspherically Decaying Radiation Beam Generated by a Rotating Superluminal Source" Optical Society of America 24(8):2443-2456 (Aug. 2007), 14 pages.

B. M. Bolotovskii et al. "Radiation of Superluminal Sources in Empty Space" Russian Academy of Science 48(9):903-915(2005), 13 pagea.

* cited by examiner

POLARIZATION CURRENT ANTENNAS THAT GENERATE SUPERLUMINAL POLARIZATION CURRENT WAVES HAVING ACCELERATION AND RELATED METHODS OF EXCITING SUCH ANTENNAS

BACKGROUND

Antennas that include a dielectric radiator that is excited using a series of polarization devices are known in the art. Such antennas are referred to herein as "polarization current antennas." An example of such a polarization current antenna is disclosed in European Patent No. 1112578 titled "Apparatus for Generating Focused Electromagnetic Radiation," filed on Sep. 6, 1999. Each polarization device may comprise, for example, a pair of electrodes that are positioned on opposite sides of a ring-shaped dielectric radiator. The dielectric radiator may be a continuous dielectric element, and the electrode pairs may be positioned side-by-side on inner and outer sides thereof. Each pair of electrodes and the portion of the dielectric radiator therebetween forms a "polarization element" of the polarization current antenna.

The above-described polarization current antenna may operate as follows. When a voltage is applied across one of the electrode pairs, an electric field is generated across the portion of the dielectric radiator therebetween. The electric field generates a displacement current within the dielectric radiator. This displacement current may be referred to as a "volume polarization current" because the current is generated by polarizing the portion of the dielectric material that is between the electrode pair throughout its volume. The generated volume polarization current emits electromagnetic radiation. A volume polarization current distribution pattern may be generated in the dielectric radiator by applying different voltages across multiple of the electrode pairs. Moreover, this volume polarization current distribution pattern may be caused to propagate within the dielectric radiator by appropriate sequencing of the energization of the electrode pairs. One example of a moving volume polarization current distribution pattern is a polarization current wave such as, for example, a sinusoidal polarization current wave that propagates through the dielectric radiator. This polarization current wave can be made to propagate through the dielectric radiator in a direction orthogonal to a vector extending between the electrodes of an electrode pair. Polarization current antennas that have dielectric radiators that are driven by individual amplifiers are known in the art. See U.S. Pat. No. 8,125,385, titled "Apparatus and Methods for Phase Fronts Based on Superluminal Polarization Current," filed Aug. 13, 2008, which is incorporated herein by reference. Polarization current antennas that are driven by a passive feed network are also known in the art. See International Patent Publication No. WO/2014/100008, which is also incorporated herein by reference. Polarization current antennas differ from conventional antennas in that their emission of electromagnetic radiation arises from a polarization current rather than a conduction or convection electric current.

Polarization current antennas that generate polarization current waves that move faster than the speed of light in a vacuum have been experimentally realized. One example of such a polarization current antenna that has already been constructed and tested functions by generating a rotating polarization current wave in a dielectric radiator that is implemented as a ring-shaped block of dielectric material. By phase-controlled excitation of the voltages that are applied to electrodes that surround the dielectric radiator, a volume polarization current can be generated that has a moving distribution pattern (i.e., a polarization current wave that travels along the dielectric radiator) that changes faster than the speed of light and exhibits centripetal acceleration. See, e.g., U.S. Patent Publication No. 2006/0192504 ("the '504 publication"); see also, U.S. patent application Ser. No. 13/368,200, titled "Superluminal Antenna" filed on Feb. 7, 2012, the disclosures of each of which are incorporated herein by reference. It should be noted that while the polarization current wave travels faster than the speed of light, the movements of the underlying charged particles that create the polarization current wave are subluminal.

FIG. 1 is a perspective view of the polarization current antenna 1 that is disclosed in the '504 publication. As shown in FIG. 1, the polarization current antenna 1 includes a ring-shaped dielectric radiator 2 that has a plurality of inner electrodes 4 that are disposed on an inner surface of the ring-shaped dielectric radiator 2 and a plurality of outer electrodes 6 that are disposed on an outer surface of the ring-shaped dielectric radiator 2. The ring-shaped dielectric radiator 2 circles an axis of rotation z. The polarization current antenna 1 of FIG. 1 produces tightly-focused packets of electromagnetic radiation that are fundamentally different from the emissions of conventional antennas.

Polarization current antennas that generate polarization current waves that move faster than the speed of light can make contributions at multiple "retarded times" to a signal received instantaneously at a location remote from the polarization current antenna. The location where the electromagnetic radiation is received may be referred to herein as an "observation point," and each "retarded time" refers to the earlier time at which a specific portion of the electromagnetic radiation that is received at the observation point at the observation time was generated by the volume polarization current. The contributions to the electromagnetic radiation made by the volume elements of the polarization current that approach the observation point, along the radiation direction, with the speed of light and zero acceleration at the retarded time, may coalesce and give rise to a focusing of the received waves in the time domain. In other words, waves of electromagnetic radiation that were generated by a volume element of the polarization current at different points in time can arrive at the same time at the observation point. The interval of time during which a particular set of electromagnetic waves is received at the observation point is considerably shorter than the interval of time during which the same set of electromagnetic waves is emitted by the polarization current antenna. As a result, part of the electromagnetic radiation emitted by the polarization current antenna possesses an intensity that decays non-spherically with a distance d from the antenna as $1/d^{2-\alpha}$ with $0<\alpha<1$ rather than as the conventional inverse square law, $1/d^2$. This does not contravene the physical law of conservation of energy. The constructively interfering waves from the particular set of volume elements of the polarization current that are responsible for the non-spherically decaying signal at a given observation point constitute a radiation beam for which the time-averaged value of the temporal rate of change of energy density is always negative. For this non-spherically decaying radiation, the flux of energy into a closed region (e.g., into the volume bounded by two large spheres centered on the source) is smaller than the flux of energy out of it because the amount of energy contained within that region decreases with time. (The area subtended by the beam increases as $d^2$, so that the flux of energy increases with distance as $d^{\alpha}$ across all cross sections of the beam.) In that it consists of caustics and so is constantly dispersed and reconstructed out of other electromagnetic waves, the beam in question has temporal characteristics radically different from those of a conventional beam of electromagnetic radiation.

SUMMARY

Pursuant to embodiments of the present invention, polarization current antennas are provided that comprise a dielectric radiator that extends along a z-axis; a plurality of polarization devices that are positioned adjacent the dielectric radiator along the z-axis that are configured to polarize respective portions of the dielectric radiator between $-l \le z \le l$; and a feed network that is configured to excite the polarization devices using a received radio frequency ("RF") signal to generate a polarization current wave that propagates in the z-axis direction through the dielectric radiator, with acceleration, at (1) a first variable speed that does not decrease as the polarization current wave moves along a first portion of the dielectric radiator and that does not increase as the polarization current wave moves along the remainder of the dielectric radiator, (2) a second variable speed that does not decrease as the polarization current wave moves along the entirety of the dielectric radiator or (3) a third variable speed that does not increase as the polarization current wave moves along the entirety of the dielectric radiator.

In some embodiments, the feed network may be configured to excite the polarization devices so that the generated polarization current wave propagates in the z-axis direction through the dielectric radiator, with acceleration, at a speed of either $dz/dt=(u^2-\omega_0{}^2z^2)^{1/2}$ or $dz/dt=u[1+(z/l)^3]^{1/2}$, where z is the position of the polarization current wave on the z-axis, u is the speed of the polarization current wave at a point where the acceleration is equal to zero and $\omega_0$ is a positive constant with the dimension of an angular frequency.

In some embodiments, the polarization current antenna may be configured so that as the generated polarization current wave propagates through the dielectric radiator from $-l$ to l it cycles through a number of wavelengths that is within 5% of an integer number of wavelengths.

In some embodiments, the polarization current antenna may be configured so that as the generated polarization current wave propagates through the dielectric radiator from $-l$ to l it cycles through a number of wavelengths that is approximately an integer number of wavelengths.

In some embodiments, the polarization devices may be configured to generate the polarization current wave so that the polarization current wave is a superposition of at least one superluminal polarization current wave that propagates through the dielectric radiator at a speed that exceeds the speed of light in a vacuum and a plurality of subluminal polarization current waves that propagate through the dielectric radiator at a speed that is less than the speed of light in a vacuum, wherein an amplitude of the at least one superluminal polarization current wave is greater than respective amplitudes of the plurality of subluminal polarization current waves. In such embodiments, the speed of the one of the plurality of polarization current waves that has the largest amplitude may be less than five times the speed of light. Moreover, the amplitude of the one of the plurality of polarization current waves that has the largest amplitude may exceed respective amplitudes of the other of the plurality of polarization current waves by a factor of $|1+Nj/m|^{-1}$, where N is the number of polarization devices and m is the number of wavelengths that the polarization current wave cycles through in passing through the dielectric radiator from $-l$ to l and j is a positive integer. Additionally, the number of polarization devices divided by the number of wavelengths that the generated polarization current wave cycles through in passing through the dielectric radiator from $-l$ to l may be at least four in some embodiments.

In some embodiments, the polarization current antenna may be configured to emit electromagnetic radiation that decays at a rate of $1/d^{2-\alpha}$ where $0<\alpha<1$ at a distance d from the polarization current antenna.

Pursuant to further embodiments of the present invention, polarization current antenna are provided that comprise a dielectric radiator that extends along a z-axis; a plurality of polarization devices that are positioned adjacent the dielectric radiator along the z-axis that are configured to polarize respective portions of the dielectric radiator between $-l \le z \le l$; and a feed network that is configured to divide a radio frequency ("RF") signal having a frequency of $\omega/2\pi$ and to supply the divided RF signal to the respective polarization devices while applying phase differences to the divided RF signal that have a dependence according to $\arcsin(\omega z_j/u)$, where $z_j$ refers to the positions of the centers of the polarization devices along the z-axis where j=1, 2, . . . N, N is equal to the number of polarization devices, u is a constant speed that exceeds the speed of light in a vacuum, or a dependence according to $$\frac{\omega\ell}{3^{1/4}u}[F(\sigma, k) - F(\sigma|_{x=0}, k)],$$

where $F(\sigma, k)$ is an elliptic integral of the first kind with the amplitude $$\sigma = \arccos\left(\frac{\sqrt{3} - 1 - z/\ell}{\sqrt{3} + 1 + z/\ell}\right)$$

and $$k = \frac{\sqrt{3} + 1}{2\sqrt{2}}.$$

In some embodiments, an amplitude function may be applied to the divided RF signal in the feed network to excite at least some of the polarization devices with different amplitude signals. This amplitude function may have a non-zero gradient at a midpoint along the length of the dielectric radiator in some embodiments.

In some embodiments, the polarization current antenna may be configured so that as the generated polarization current wave propagates through the dielectric radiator from $-l$ to l it cycles through a number of wavelengths that is approximately an integer number of wavelengths In some embodiments, the polarization devices may be configured to generate the polarization current wave so that it is a superposition of at least one superluminal polarization current wave that propagates through the dielectric radiator at a speed that exceeds the speed of light in a vacuum and a plurality of subluminal polarization current waves that propagate through the dielectric radiator at a speed that is less than the speed of light in a vacuum, wherein an amplitude of the at least one superluminal polarization current wave is greater than respective amplitudes of the plurality of subluminal polarization current waves. In some such embodiments, the speed of the one of the plurality of polarization current waves that has the largest amplitude may be less than five times the speed of light. The amplitude of the one of the plurality of polarization current waves that has the largest amplitude may exceed respective amplitudes of the other of the plurality of polarization current waves by a factor of $|1+Nj/m|^{-1}$ in some embodiments, where N is the number of polarization devices and m is the number of wavelengths that the polarization current wave cycles through in passing through the dielectric radiator from −l to l and j is a positive integer. The number of polarization devices divided by the number of wavelengths that the generated polarization current wave cycles through in passing through the dielectric radiator from −l to l may be at least four in some embodiments.

In some embodiments, the amplitude function may have a non-zero gradient at a point along the length of the dielectric radiator where the polarization current wave will exhibit zero acceleration.

In some embodiments, the polarization current antenna may be configured to emit electromagnetic radiation that decays at a rate of $1/d^{2-\alpha}$ where $0<\alpha<1$ at a distance d from the polarization current antenna.

Pursuant to still further embodiments of the present invention, polarization current antennas are provided that comprise a dielectric radiator that extends along a z-axis; a plurality of polarization devices that are configured to polarize respective portions of the dielectric radiator between $-l\leq z\leq l$; and a feed network that is configured to excite the polarization devices using a received radio frequency ("RF") signal to generate a polarization current wave that propagates in the z-axis direction through the dielectric radiator, where the polarization current antenna is configured so that as the generated polarization current wave propagates through the dielectric radiator from −l to l it cycles through a number of wavelengths that is within 20% of an integer number of wavelengths.

In some embodiments, the polarization current antenna may be configured so that as the generated polarization current wave propagates through the dielectric radiator from −l to l it cycles through a number of wavelengths that is within 10% of an integer number of wavelengths.

In some embodiments, the polarization current antenna may be configured so that as the generated polarization current wave propagates through the dielectric radiator from −l to l it cycles through a number of wavelengths that is within 5% of an integer number of wavelengths.

In some embodiments, the polarization current antenna may be configured so that as the generated polarization current wave propagates through the dielectric radiator from −l to l it cycles through a number of wavelengths that is approximately an integer number of wavelengths.

In some embodiments, the generated polarization current wave may propagate through the dielectric radiator, with acceleration, at one of a first speed of $dz/dt=(u^2+\omega_0^2z^2)^{1/2}$, a second speed of $dz/dt=(u^2-\omega_0^2z^2)^{1/2}$ or a third speed of $dz/dt=u[1+(z/l)^3]^{1/2}$, where z is the position of the polarization current wave on the z-axis, u is the speed of the polarization current wave at a point where the acceleration is equal to zero and $\omega_0$ is a positive constant with the dimension of an angular frequency.

In some embodiments, the polarization devices may be configured to generate the polarization current wave so that it is a superposition of at least one superluminal polarization current wave that propagates through the dielectric radiator at a speed that exceeds the speed of light in a vacuum and a plurality of subluminal polarization current waves that propagate through the dielectric radiator at a speed that is less than the speed of light in a vacuum, wherein an amplitude of the at least one superluminal polarization current wave is greater than respective amplitudes of the plurality of subluminal polarization current waves.

In some embodiments, the speed of the one of the plurality of polarization current waves that has the largest amplitude may be less than five times the speed of light.

In some embodiments, the polarization current antenna may be configured to emit electromagnetic radiation that decays at a rate of $1/d^{2-\alpha}$ where $0<\alpha<1$ at a distance d from the polarization current antenna.

In some embodiments, an amplitude function may be applied to the RF signal in the feed network to excite at least some of the polarization devices with different amplitude signals. The amplitude function may have a non-zero gradient at a midpoint along the length of the dielectric radiator in some embodiments.

Pursuant to yet further embodiments of the present invention, polarization current antennas are provided that comprise a dielectric radiator that extends along a z-axis; a plurality of polarization devices that are positioned adjacent the dielectric radiator along the z-axis that are configured to polarize respective portions of the dielectric radiator between $-l\leq z\leq l$; and a feed network that is configured to excite the polarization devices using a received radio frequency ("RF") signal to generate a polarization current wave that propagates in the z-axis direction through the dielectric radiator, where the generated polarization current wave is a superposition of a plurality of polarization current waves, and wherein only one of the plurality of polarization current waves travels at a speed that exceeds the speed of light in a vacuum.

In some embodiments, the one of the plurality of polarization current waves that travels at the speed that exceeds the speed of light may have the largest amplitude of the plurality of polarization current waves.

In some embodiments, the speed of the one of the plurality of polarization current waves that travels at the speed that exceeds the speed of light may be less than five times the speed of light.

In some embodiments, the amplitude of the one of the plurality of polarization current waves that travels at the speed that exceeds the speed of light may exceed respective amplitudes of the other of the plurality of polarization current waves by a factor of $|1+Nj/m|^{-1}$, where N is the number of polarization devices and m is the number of wavelengths that the polarization current wave cycles through in passing through the dielectric radiator from −l to l and j is a positive integer.

In some embodiments, the number of polarization devices divided by the number of wavelengths that the polarization current wave cycles through in passing through the dielectric radiator from −l to l may be at least four.

In some embodiments, the number of wavelengths that the polarization current wave cycles through in passing through the dielectric radiator from −l to l may be substantially an integer.

In some embodiments, an amplitude function may be applied to the RF signal in the feed network to excite at least some of the polarization devices with different amplitude signals. The amplitude function may have a non-zero gradient at a midpoint along the length of the dielectric radiator in some embodiments.

Pursuant to yet further embodiments of the present invention, polarization current antennas are provided that comprise a dielectric radiator that extends along a z-axis; a plurality of polarization devices that are positioned adjacent the dielectric radiator along the z-axis that are configured to polarize respective portions of the dielectric radiator between $-l \leq z \leq l$; and a feed network that is configured to excite the polarization devices to generate a volume polarization current distribution pattern that propagates in the z-axis direction through the dielectric radiator, where the generated volume polarization current distribution pattern is a superposition of at least one superluminal volume polarization current distribution pattern that propagates through the dielectric radiator at a speed that exceeds the speed of light in a vacuum and a plurality of subluminal volume polarization current distribution patterns that propagate through the dielectric radiator at a speed that is less than the speed of light in a vacuum, and where an amplitude of the at least one superluminal volume polarization current distribution pattern is greater than respective amplitudes of the plurality of subluminal volume polarization current distribution patterns.

In some embodiments, the generated volume polarization current distribution pattern may comprise a generated polarization current wave, and wherein the polarization current antenna is configured so that as the generated polarization current wave propagates through the dielectric radiator from $-l$ to $l$ it cycles through a number of wavelengths that is approximately an integer number of wavelengths.

In some embodiments, the at least one superluminal volume polarization current distribution pattern may be the only one of the volume polarization current distribution patterns that propagates through the dielectric radiator at a speed that exceeds the speed of light.

In some embodiments, the plurality of polarization devices may comprise a plurality of first electrodes that are aligned in a row along the length of the dielectric radiator and a continuous ground plane that extends along the length of the dielectric radiator opposite the plurality of first electrodes.

In some embodiments, the plurality of polarization devices may comprise a plurality of first electrodes that are aligned in a row along the length of the dielectric radiator and a plurality of second electrodes that are aligned in a row along the length of the dielectric radiator opposite the plurality of first electrodes.

In some embodiments, the polarization current antenna may be configured to emit electromagnetic radiation that decays at a rate of $1/d^{2-\alpha}$ where $0<\alpha<1$ at a distance d from the polarization current antenna.

In some embodiments, the speed of the at least one superluminal volume polarization current distribution pattern may be less than five times the speed of light.

DETAILED DESCRIPTION

Figure 1:
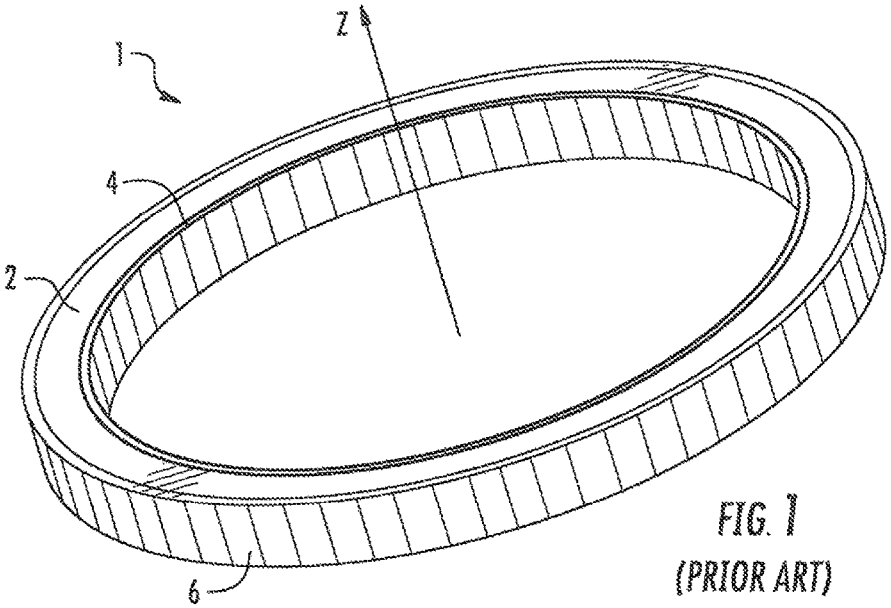
FIG. 1 (PRIOR ART)
FIG. 1 is a schematic perspective view of a known polarization current antenna.

As discussed above, polarization current antennas have been proposed which have a ring-shaped dielectric radiator with pairs of opposed electrodes situated on opposite sides thereof. The electrode pairs may be excited in a phase-controlled manner to generate a polarization current wave (or other volume polarization current distribution pattern) that travels along the dielectric radiator with a phase speed that exceeds the speed of light in vacuum. The goal is to use this antenna to generate electromagnetic radiation that has an intensity that diminishes at a rate of $1/d^{2-\alpha}$ with $0<\alpha<1$ for a distance d from the antenna as opposed to $1/d^2$ as is the case with conventional antennas. To generate such electromagnetic radiation, the polarization current wave must travel not only with a speed exceeding the speed of light in vacuum but also with a non-zero acceleration. In the above-described polarization current antenna, this acceleration is provided by the centripetal acceleration that is inherently generated by the ring-shaped dielectric radiator.

Polarization current antennas that have a linear dielectric radiator have also been proposed. In such a polarization current antenna, the polarization current wave moves rectilinearly along the dielectric radiator. Consequently, the acceleration that is necessary to obtain coalescence of the signal at a remote observation point must be created by inducing phase differences between the oscillations of neighboring polarization elements that depend on their positions along the rectilinear dielectric radiator. When the speed of the polarization current wave exceeds the speed of light in a vacuum on the plane where its acceleration vanishes, these rectilinear polarization current antennas also emit electromagnetic radiation having an intensity that diminishes as $1/d^{2-\alpha}$ with $0<\alpha<1$ at a distance d from the antenna.

Pursuant to embodiments of the present invention, acceleration profiles or "schemes" are provided that may be used in exciting the polarization devices of a polarization current antenna so that the antenna will emit radiation with intensities that, at least in part, decay non-spherically with a distance d from the source as $1/d^{2-\alpha}$ with $0<\alpha<1$ rather than as the conventional inverse square law, $1/d^2$. Pursuant to some embodiments, polarization current antennas are provided that have electrodes or other polarization devices that are excited by acceleration schemes having certain profiles. For example, in some embodiments, the polarization current wave may be accelerated such that it will have a speed that always increases as it moves through the dielectric radiator. In other embodiment, the polarization current wave may be accelerated such that it will have a speed that always decreases as it moves through the dielectric radiator. In still other embodiments, the polarization current wave may be accelerated such that it will have a speed that gradually increases as moves through a first portion of the dielectric radiator and a speed that gradually decreases as it move though the remainder of the dielectric radiator. In yet other embodiments, the polarization current wave may be accelerated such that it will have a speed that gradually decreases as moves through a first portion of the dielectric radiator and a speed that gradually increases as it move though the remainder of the dielectric radiator.

Specific examples of such acceleration schemes are disclosed herein including the so-called "arcsin", "arcsin h" and "elliptic" acceleration profiles. As will be explained in detail herein, the use of such acceleration profiles may result in enhanced narrowing of the radiation pattern emitted by the polarization current antenna so that a greater percentage of the emitted radiation will decay with distance d from the antenna as $1/d^{2-\alpha}$ with $0<\alpha<1$ as opposed to $1/d^2$ as is the case with conventional antennas. While the use of these acceleration profiles may be particularly advantageous with polarization current antennas that have a linear dielectric radiator, it will be appreciated that these acceleration profiles or modified versions thereof may also be used with polarization current antennas that have arc-shaped dielectric radiators or other shaped dielectric radiators.

In some embodiments, polarization current antennas are provided that include a dielectric radiator that extends along a z-axis and a plurality of polarization devices that are positioned adjacent the dielectric radiator along the z-axis that are configured to polarize respective portions of the dielectric radiator between $-l\leq z\leq l$. These polarization current antennas may further include a feed network that is configured to excite the polarization devices using a received radio frequency ("RF") signal to generate a polarization current wave that propagates in the z-axis direction through the dielectric radiator, with acceleration, at a speed of (1) $dz/dt=(u^2-\omega_0^2z^2)^{1/2}$, (2) a speed of $dz/dt=(u^2+\omega_0^2z^2)^{1/2}$ or (3) a speed of $dz/dt=u[1+(z/l)^3]^{1/2}$, where z is the position of the polarization current wave on the z-axis, u is the speed of the polarization current wave at a point where the acceleration is equal to zero and $\omega_0$ is a positive constant with the dimension of an angular frequency. These speeds correspond to polarization current waves that have the arcsin, arcsin h and elliptic acceleration profiles, respectively, as will be shown herein.

In further embodiments, polarization current antennas are provided that include a dielectric radiator that extends along a z-axis and a plurality of polarization devices that are positioned adjacent the dielectric radiator along the z-axis that are configured to polarize respective portions of the dielectric radiator between $-l\leq z\leq l$. These polarization current antennas further include a feed network that is configured to excite the polarization devices using a received RF signal to generate a polarization current wave that propagates in the z-axis direction through the dielectric radiator, where the generated polarization current wave is formed so that as it propagates through the dielectric radiator from $-l$ to l it cycles through a number of wavelengths that is at least close to an integer number of wavelengths. For example, in various embodiments, the generated polarization current wave may be formed so that as it propagates through the dielectric radiator from $-l$ to l it cycles through a number of wavelengths that is within at 20%, 10% or 5% of an integer number of wavelengths. In some embodiments, the generated polarization current wave may be formed so that as it propagates through the dielectric radiator from $-l$ to l it cycles through about an integer number of wavelengths.

In still other embodiments, polarization current antennas are provided that include a dielectric radiator that extends along a z-axis and a plurality of polarization devices that are positioned adjacent the dielectric radiator along the z-axis that are configured to polarize respective portions of the dielectric radiator between $-l\leq z\leq l$. These polarization current antennas further include a feed network that is configured to excite the polarization devices using a received RF signal to generate a polarization current wave that propagates in the z-axis direction through the dielectric radiator, where the generated polarization current wave is a superposition of a plurality of polarization current waves, and where only one of the plurality of polarization current waves travels at a speed that exceeds the speed of light in a vacuum (i.e., is superluminal). In some embodiments, the superluminal polarization current wave may be the one of the plurality of polarization current waves that has the largest amplitude. In some embodiments, the superluminal polarization current wave may travel at less than five times the speed of light.

In further embodiments, polarization current antennas are provided that include a dielectric radiator that extends along a z-axis, a plurality of polarization devices that are positioned adjacent the dielectric radiator along the z-axis that are configured to polarize respective portions of the dielectric radiator between $-l\leq z\leq l$ and a feed network that is configured to excite the polarization devices to generate a volume polarization current distribution pattern that propagates in the z-axis direction through the dielectric radiator.

In these antennas the generated volume polarization current distribution pattern is a superposition of at least one superluminal volume polarization current distribution pattern that propagates through the dielectric radiator at a speed that exceeds the speed of light in a vacuum and a plurality of subluminal volume polarization current distribution patterns that propagate through the dielectric radiator at a speed that is less than the speed of light in a vacuum. Moreover, an amplitude of the at least one superluminal volume polarization current distribution pattern is greater than respective amplitudes of the plurality of subluminal volume polarization current distribution patterns.

In some embodiments, an amplitude function is applied to the RF signal in the feed network to excite at least some of the polarization devices with different amplitude signals. In some embodiments, the amplitude function may have a non-zero gradient at a midpoint along the length of the dielectric radiator.

Before describing various embodiments of the present invention in greater detail, additional background regarding the configuration and operation of polarization current antennas will first be provided.

In a conventional phased array antenna, each radiating element may be considered a point source of electromagnetic radiation. The radiating elements may be separated by a distance that is proportional to the wavelength of an RFsignal that is emitted by the radiating element. The electromagnetic radiation is generated by surface currents, such as surface currents generated on dipole or patch radiating elements.

In contrast to such point-source electromagnetic radiation sources, the polarization current antennas according to embodiments of the present invention produce a continuous, moving source of electromagnetic radiation that is generated by a polarization current wave that flows through a dielectric radiator.

The production and propagation of electromagnetic radiation in the polarization current antennas according to embodiments of the present invention is described by the following two of Maxwell equations:

$$\nabla \times E = \partial B/\partial t \tag{1}$$

$$\nabla \times H = J_{free} + \varepsilon_0 \partial E/\partial t + \partial P/\partial t \tag{2}$$

In Equations (1) and (2), H is the magnetic field strength, B is the magnetic induction, P is polarization, and E is the electric field, and all terms are in SI units. The (coupled) terms in B, E and H of Equations (1) and (2) describe the propagation of electromagnetic radiation. The generation of electromagnetic radiation is encompassed by the source terms $J_{free}$ (the current density of free charges) and $\partial P/\partial t$ (the polarization current density). An oscillating $J_{free}$ is the basis of conventional radio transmission. The charged particles that make up $J_{free}$ have finite rest mass, and therefore cannot move with a speed that exceeds the speed of light in vacuo. Practical polarization current antennas employ a volume polarization current to generate electromagnetic radiation, which is represented by the volume polarization current density $\partial P/\partial t$.

Figure 2:
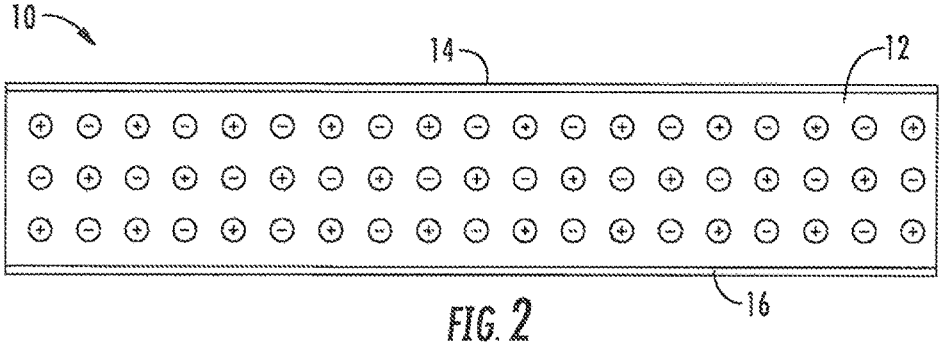
FIGS. 2 and 3 are schematic side views of a device that includes a dielectric radiator and a single upper electrode that illustrate how a volume polarization current can be induced in a dielectric radiator.
Figure 3:
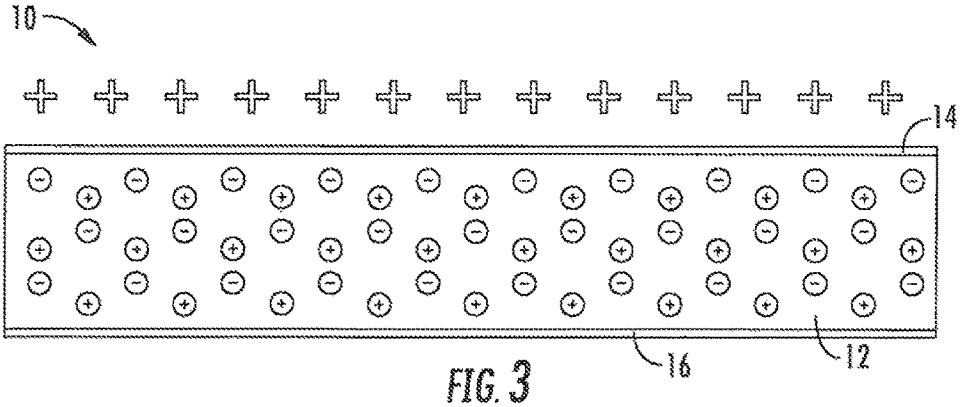

The principles of such polarization current antennas are outlined in FIGS. 2-5. In particular, FIGS. 2 and 3 schematically illustrate a device 10 that includes a dielectric radiator 12. An electrode 14 is provided on one side of the dielectric radiator 12 and a ground plane 16 is provided on the other (opposite) side of the dielectric radiator 12. The dielectric radiator 12 is an electrical insulator that may be polarized by applying an electric field thereto. When the electric field is applied, electric charges in the portion of the dielectric radiator 12 effected by the electrical field shift from their average equilibrium positions causing polarization in this portion of the dielectric radiator 12. When the dielectric radiator 12 is polarized, positive charges are displaced in the same direction as that of the electric field and negative charges shift in the opposite direction away from the electric field.

In the example of FIG. 2, no electric field is applied across the dielectric radiator 12 via the electrode 14 and ground plane 16, so the charges in the dielectric radiator 12 are shown as being randomly distributed to indicate that they are in their average equilibrium positions. In the example of FIG. 3, a voltage has been applied to the electrode 14 to generate an electric field across the dielectric radiator 12. As shown in FIG. 3, in response to this voltage, the positive and negative charges shift slightly from their average equilibrium positions (see FIG. 2) to move in opposite directions with the positive charges shifting towards the applied voltage and the negative charges shifting away. A finite polarization P has therefore been induced in the dielectric radiator 12. A changing state of polarization P corresponds to charge movement, and so is equivalent to current. Thus, changes to the state of the polarization P of the dielectric radiator 12—such as the change shown between FIGS. 2 and 3—may generate electromagnetic radiation.

Figure 4:
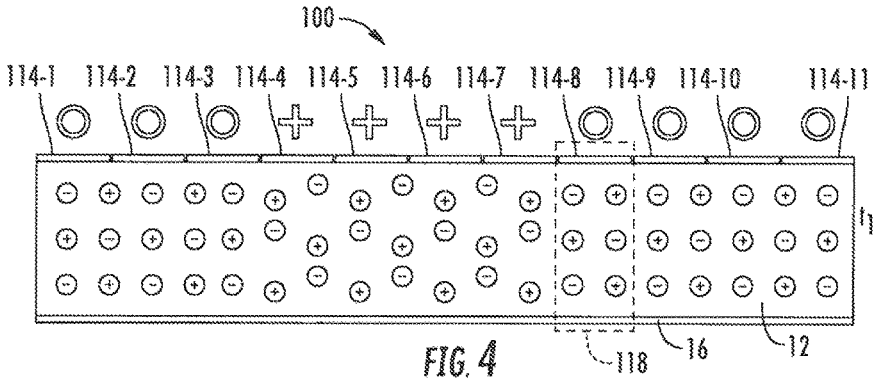
FIGS. 4 and 5 are schematic side views of a polarization current antenna that includes a dielectric radiator and a plurality of upper electrodes that illustrate how a volume polarization current distribution pattern can be generated and made to move within the dielectric radiator.
Figure 5:
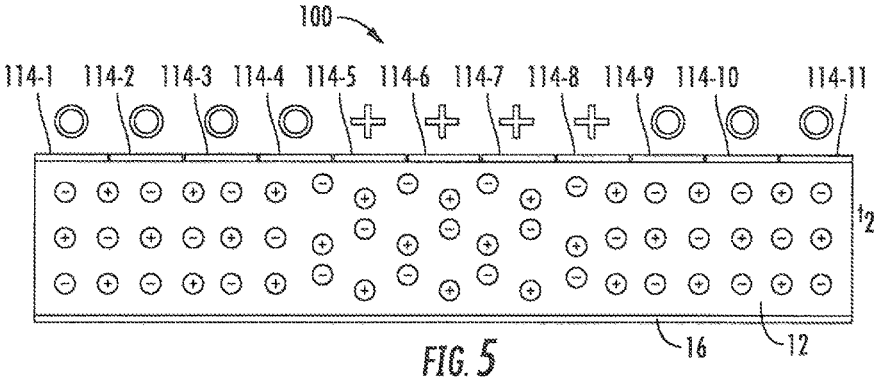

FIGS. 4 and 5 illustrate a polarization current antenna 100. The polarization current antenna 100 is similar to the device 10 of FIGS. 2 and 3, except that in the polarization current antenna of FIGS. 4 and 5 the electrode 14 of the device 10 of FIGS. 2-3 has been replaced with a plurality of smaller electrodes labeled 114-1 through 114-11 (which are collectively referred to herein as the electrodes 114) that are arranged in a side-by-side relationship. Each electrode 114, in conjunction with a portion of the dielectric radiator 12 and a portion of the ground plane 16, forms a polarization element 118 of the polarization current antenna 100. One such polarization element 118 is shown in the dashed box in FIG. 4. As a plurality of separate electrodes 114 are provided in the polarization current antenna 100 of FIGS. 4-5, a spatially-varying electric field may be applied across the dielectric radiator 12 by simultaneously applying different voltages to different ones of the electrodes 114. Moreover, the distribution pattern of the electric field can be made to move by, for example, applying voltages in sequence to the electrodes 114 (i.e., a voltage is applied to the first electrode 114-1 only, and then removed as a voltage is applied to the second electrode 114-2, which is then removed as a voltage is applied to the third electrode 114-3, etc.). Referring to FIGS. 4 and 5, if the distribution pattern of this spatially-varying electric field is made to move, then the polarized region moves with it; thereby producing a traveling "wave" of P that moves along the dielectric radiator 12 (and also, by virtue of the time dependence imposed by movement, a traveling wave of $\partial P/\partial t$). As noted above, this traveling "wave" of P may be referred to herein as a "polarization current wave." This polarization current wave generates electromagnetic radiation as it moves along the dielectric radiator 12. While in the description that follows will primarily focus on polarization current waves that move through a dielectric radiator, it will be appreciated that volume polarization current distribution patterns other than polarization current waves may be made to move through the dielectric radiator. Embodiments of the present invention encompass such moving but non-wave-like volume polarization current distribution patterns.

FIG. 4 illustrates the position of a polarized region of the dielectric radiator 12 at time $t_1$. As shown in FIG. 4, at time $t_1$ electrodes 114-1 through 114-3 and 114-8 through 114-11 are not energized, while a voltage is applied to electrodes 114-4 through 114-7. In this state, an electric field exists between electrodes 114-4 through 114-7 and the ground plane 16, and therefore a polarized region also exists in the dielectric radiator 12 adjacent to electrodes 114-4 through 114-7. The state of the antenna 100 at time $t_2$ is illustrated in FIG. 5. At time $t_2$, the voltage is removed from electrode 114-4 and a voltage is applied to electrode 114-8. The electric field, and therefore the polarized region, has moved one electrode 114 to the right. Note that this polarization current wave can move arbitrarily fast (i.e. faster than the speed of light in vacuo) because the polarization current wave is generated by movement of charges in a first direction (i.e., the vertical direction in FIGS. 4-5) while the polarization current wave moves in a second direction that is orthogonal to the first direction (i.e., the horizontal direction in FIGS. 4-5 as the polarization current wave moves along the dielectric radiator 12). Thus, the individual charges do not themselves move faster than the speed of light, while the polarization current wave may be made to move faster than the speed of light. As a simple example, this phenomenon is akin to a "wave" that is created by fans standing up and down in a stadium during an athletic event. The speed at which the wave moves through the stadium is a function of a number of factors, only one of which is the speed at which the individual spectators stand up and sit down, and hence the speed of the wave can be made to be faster than the speed at which the individuals creating the wave move.

Various embodiments of the present invention will now be discussed in greater detail with respect to FIGS. 6-17.

Figure 6:
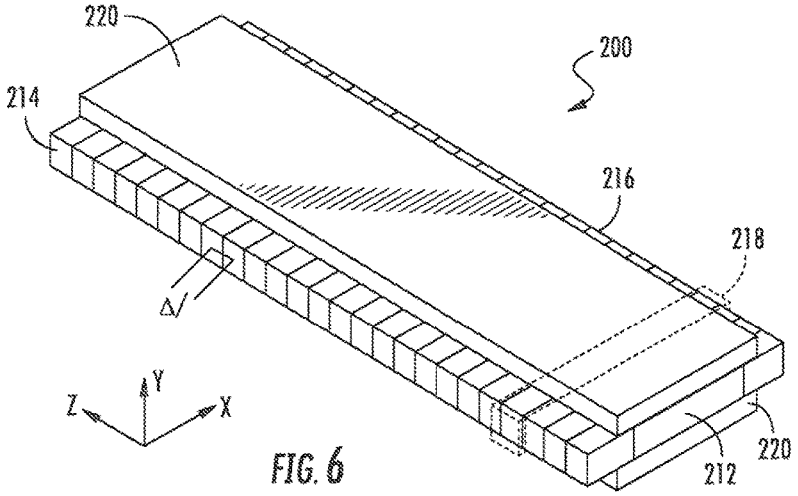
FIG. 6 is a schematic perspective view of a polarization current antenna with a rectilinear dielectric radiator according to embodiments of the present invention.

FIG. 6 is a perspective view of a polarization current antenna 200 according to embodiments of the present invention. As shown in FIG. 6, the polarization current antenna 200 includes a dielectric radiator 212, a plurality of upper electrodes 214 and a plurality of lower electrodes 216. Top and bottom covers 220 may be provided that hold the electrodes 214, 216 in place. Each pair of electrodes 214, 216 constitutes a polarization device. The polarization current antenna 200 may further include a corporate feed network (not shown) that is used to supply an excitation signal to the upper electrodes 214, as will be discussed in further detail below.

Figure 6A:
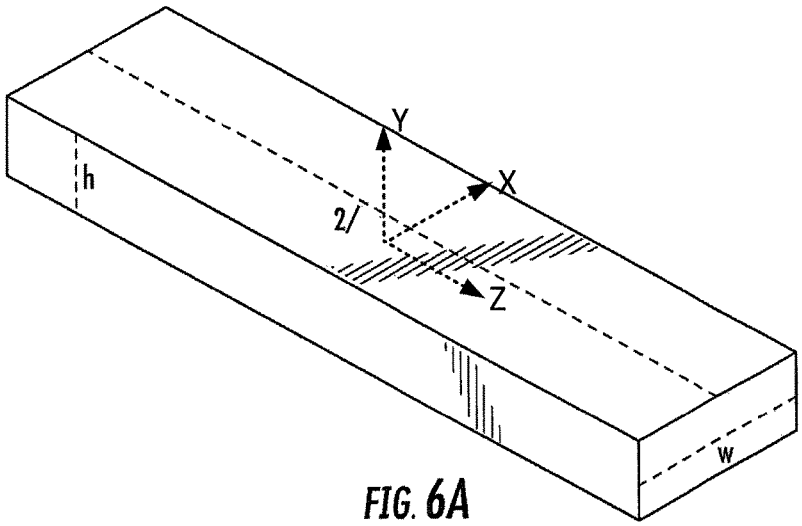
FIG. 6A is a schematic perspective view of a dielectric radiator of the polarization current antenna of FIG. 6.

FIG. 6A is a schematic perspective view of the dielectric radiator 212. The dielectric radiator 212 may be formed of a dielectric material such as, for example, alumina. The dielectric radiator 212 is rectangular in shape and has a length 2l extending along the z-axis, a width w extending along the x-axis, and a height (thickness) h extending along the y-axis. The upper and lower electrodes 214, 216 may be aligned along the x-axis so as to be arranged in pairs. Each pair of an upper electrode 214 and a lower electrode 216 and the portion of the dielectric radiator 212 disposed therebetween forms a respective polarization element 218, as shown in FIG. 6. The electrodes 214, 216 may be formed of a conductive material such as, for example, copper or a copper coated material.

It will be appreciated that polarization devices other than a pair of electrodes 214, 216 may be used to apply an electric field across a portion of the dielectric radiator 212. For example, in other embodiments, the lower electrodes 216 may be replaced with a continuous ground plane. In such an embodiment, each polarization device may comprise an electrode 214 that is electrically coupled with the ground plane with the dielectric radiator 212 therebetween. Such a ground plane 16 is an "electrode" which receives a ground voltage. In still other embodiments, structures other than electrodes may be used to polarize the dielectric radiator 212. In each of these examples, the polarization devices are preferably sized such that a plurality of polarization devices may be located closely adjacent to each other so that, when excited in sequence, the polarization devices apply a stepped approximation of a continuous electric field distribution to the dielectric radiator 212 as will be explained in greater detail below.

The dielectric radiator 212 in the example of FIG. 6 comprises a continuous dielectric block. Each upper electrode 214 has the same length (in the z-axis direction), the same width (in the x-axis direction) and the same height (in the y-axis direction), and the upper electrodes 214 are spaced apart from each other in the z-axis direction by uniform amounts. The spacings between adjacent upper electrodes 214 in the z-axis direction may be made to be very small in some embodiments, as shown in FIG. 6. For example, a sidewall of each upper electrode 214 may be coated with a thin insulative material to space adjacent upper electrodes 214 apart from each other. The center of each upper electrode 214 is spaced apart from the centers of each adjacent upper electrode 214 by a constant distance $\Delta l$. Likewise, each lower electrode 216 has the same length (in the z-axis direction), the same width (in the x-axis direction) and the same height (in the y-axis direction). The lower electrodes 216 are spaced apart by uniform amounts so that the center of each lower electrode 216 is spaced apart from the centers of adjacent lower electrodes 216 by the constant distance $\Delta l$. While the dielectric radiator 212 is depicted as a continuous block in FIG. 6, it will be appreciated that a plurality of discrete dielectric radiators may be used instead in other embodiments, which may or may not touch one another.

As will be explained in further detail below, if the number of electrode pairs N is sufficiently large, a sinusoidal distribution of polarization (or other distribution) can be generated along the length of the dielectric radiator 212 by applying a voltage to each electrode pair 214, 216 independently. As discussed above with reference to FIGS. 4-5, the distribution pattern of this polarization can then be set in motion by energizing the electrodes 214, 216 with time-varying voltages to create a polarization current wave that travels through the dielectric radiator 212. In the example of FIGS. 6 and 6A, the dielectric radiator 212 lies along the z-axis of a Cartesian coordinate system and occupies the segment $-l \le z \le l$ of the z-axis.

The polarization current antenna 200 may be used, for example, to transmit an information signal. Typically, radio frequency communications involves modulating an information signal onto a carrier signal, where the carrier signal is typically a sinusoidal signal having a frequency in a desired transmission band. By way of example, the various different cellular communications networks have fixed frequency bands of operation in which the signals that are transmitted between base stations and mobile terminals are transmitted at frequencies within the specified frequency range. One way to use the polarization current antenna 200 to transmit an information signal is to modulate the information signal onto a sinusoidal waveform that oscillates at a desired radio frequency (e.g., 2.5 GHz) and to use this modulated RF signal to excite the electrodes of the polarization current antenna 200. This can be accomplished using, for example, a passive corporate feed network in some embodiments. The corporate feed network is used to divide the modulated RF signal into a plurality of smaller magnitude sub-components. The number of sub-components may be equal to the number of polarization elements 218 (N) included in the polarization current antenna 200, so that a sub-component of the modulated RF signal is applied to, for example, each electrode 214. In some embodiments, the magnitude of each sub-component of the RF signal may be the same, but the corporate feed network may include phase shifts so that the phase of the RF signal received at each polarization element 218 at any given point in time varies.

With this approach, at any given point in time, a sub-component of the modulated RF signal is applied to all of the polarization elements 218. At a first point in time $t_1$, the modulated RF signal will have a fixed amplitude. However, the sub-components of the modulated RF signal that are applied to each polarization element 218 have respective phase offsets, and hence the magnitude of the signal applied to any given polarization element 218 will vary since the modulated RF signal is sinusoidal, and hence the magnitude varies as a function of time, or equivalently, phase. At a subsequent point in time $t_2$, the magnitude of the modulated RF signal will have changed in a known manner based on the frequency of the signal and the time difference $t_2-t_1$. This is shown graphically in FIG. 7.

Figure 7:
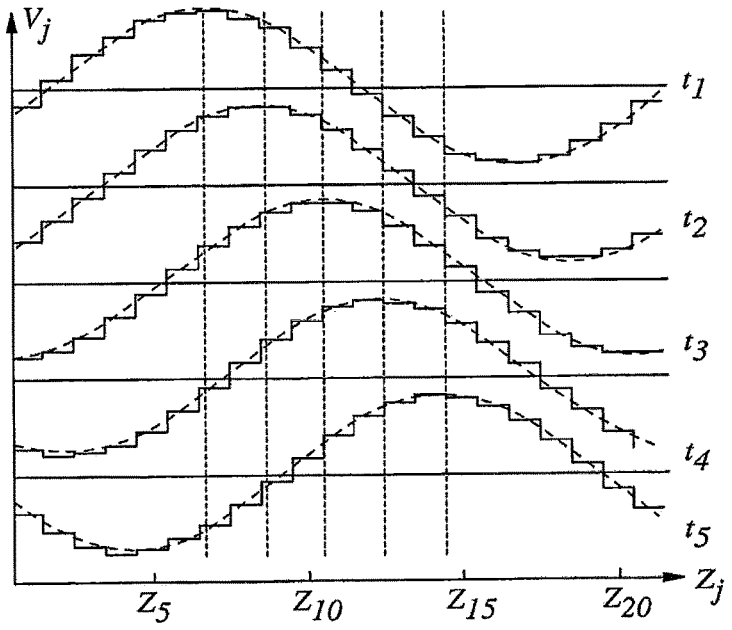
FIG. 7 is a graph illustrating the application of discretized sinusoidally varying voltages to the polarization elements of a polarization current antenna at five equally-spaced consecutive time intervals.

In particular, FIG. 7 illustrates the voltages $V_j$ that may be applied to the upper electrodes 214 of twenty consecutive polarization elements 218 of the polarization current antenna 200 (only twenty polarization elements 218 are shown to simplify the drawing). The lower electrodes 216 may be connected to a constant reference voltage such as a ground voltage. The five separate curves in FIG. 7 illustrate the voltages $V_j$ applied to the upper electrodes 214 of the twenty polarization elements at five equally-spaced consecutive times ($t_1<t_2<t_3<t_4<t_5$). The polarization elements 218 are identified in FIG. 7 according to the z-axis coordinate $z_j$ (j=1, 2, 3, . . . ) of the center of each polarization element 218. In FIG. 7, the horizontal axis corresponds to the position of each of the twenty polarization elements 218 along the z-axis and the vertical axis shows the voltage $V_j$ that is applied to each of the twenty polarization elements 218 at these positions. The five curves show the respective voltages $V_j$ applied to the twenty polarization elements 218 at the five different points in time $t_1$ through $t_5$. The vertical dotted lines designate the corresponding consecutive positions of the constant-phase surface on which $V_j$ is maximum. For example, the leftmost vertical dotted line in FIG. 7 shows the position along the z-axis of the upper electrode 214 that has the maximum voltage $V_j$ applied at time $t_1$ (i.e., the electrode pair at position $z_7$), while the rightmost vertical dotted line in FIG. 7 shows the position along the z-axis of the upper electrode 214 that has the maximum voltage $V_j$ applied at time $t_5$ (i.e., the upper electrode at position $z_{15}$). As can be seen in FIG. 7, over time a sinusoidally varying excitation signal is applied to the polarization elements 218.

In FIG. 7, $V_j \propto \cos[\omega(t-j\Delta t)]$ where $\Delta t$ is the time delay between consecutive ones of the time intervals ($t_1<t_2<t_3<t_4<t_5$). Accordingly, the constant phase difference $\omega\Delta t$ between adjacent polarization elements 218 results in a sinusoidal polarization current wave that propagates to the right through the dielectric radiator 212 with the speed $(z_{j+1}-z_j)/\Delta t$. While a polarization current wave is one type of volume polarization current distribution pattern that may be made to propagate through the dielectric radiator 212, it will be appreciated that in other embodiments volume polarization current distribution patterns that are not waves may be made to propagate through the dielectric radiator 212.

In designing a practical polarization current antenna, various parameters should be considered such as the number of polarization elements to include in the antenna and the number of wavelengths that the polarization current wave will cycle through as it moves from one end of the dielectric radiator 212 to the other end. As noted above, in the polarization current antenna 200 of FIG. 6, the dielectric radiator 212 lies along the z-axis of a Cartesian coordinate system and occupies the segment $-l \le z \le l$ of the z-axis. If the upper electrodes 214 had vanishingly small lengths along the z-axis direction and were driven with a harmonically oscillating voltage whose frequency $\omega/2\pi$ is fixed but whose phase depends on the z-axis position of the upper electrode 214 along the length of the dielectric radiator 212, a polarization current wave $W_{cv}(z, t)$ may be generated that propagates through the dielectric radiator 212 that may be characterized as follows:

$$W_{cv}(z,t)=\cos[\omega(t-z/u)],\ -l\le z\le l, \tag{3}$$

where u is the phase speed (also referred to herein as simply "speed") at which the polarization current wave propagates through the dielectric radiator 212.

In any actual implementation, the upper electrodes 214 will not have vanishingly small lengths along the z-axis direction. To account for this, the polarization current wave $W_{cv}(z, t)$ of Equation (3) may be approximated as follows:

$$W_{cv}(z,t) \simeq \sum_{k=0}^{N-1} \Pi\left(\frac{Nz}{2\ell}+\frac{N-1}{2}-k\right)\cos\left(\omega t-\frac{2\pi mk}{N}\right) \tag{4}$$

where $\Pi(x)$ denotes a rectangle function that is unity when $|x|<½$ and zero when $|x|>½$. Note that the rectangle function $\Pi(x)$ in Equation (4) is non-zero for any given k only over the interval:

$$\ell\left(\frac{2k}{N}-1\right) \le z \le \ell\left[\frac{2(k+1)}{N}-1\right] \tag{5}$$

so that the first electrode (k=0) is within the segment $-l\le z\le(-l+2l/N)$ and the last electrode (k=N−1) is within the segment $(l-2l/N)\le z\le l$. The phase with which each upper electrode 214 oscillates increases linearly with its position along the dielectric radiator 212 from zero to $2m\pi$, where the parameter m represents the number of wavelengths that the polarization current wave will cycle through as it travels from one end of the dielectric radiator 212 to the other. Fourier-series representation of the above rectangle function with the period 2l is given by:

$$\Pi\left(\frac{Nz}{2\ell}+\frac{N-1}{2}-k\right)=\frac{1}{N}+\sum_{n=1}^{\infty}\frac{2}{n\pi}\sin\frac{n\pi}{N}\cos\left[n\pi\left(\frac{z}{\ell}-\frac{2k+1}{N}+1\right)\right] \tag{6}$$

By inserting Equation (6) into Equation (4) and using formula (4.3.32) of M. Abramowitz and I. A. Stegun, *Handbook of Mathematical Functions* (Dover, N.Y., 1970) to rewrite the product of the two cosines in the resulting expression as the sum of two cosines, two infinite series are obtained, each involving a single cosine and extending over n=1, 2, . . . , ∞. These two infinite series can then be combined (by replacing n in one of them by −n everywhere and performing the summation over n=−1, −2, . . . , −∞) to arrive at:

$$W_{cv}(z,t) \simeq \sum_{n=-\infty}^{\infty} \frac{1}{n\pi} \sin\frac{n\pi}{N} \sum_{k=0}^{N} \cos\left[\frac{2\pi(n-m)k}{N} + \omega t - n\pi\left(\frac{z}{\ell} + \frac{N-1}{N}\right)\right] \quad (7)$$

in which the order of summations with respect to n and k has been interchanged and the contribution $N^{-1}$ on the right-hand side of Equation (6) has been incorporated into the n=0 term. The coefficient $(n\pi)^{-1}\sin(n\pi/N)$ has the value $N^{-1}$ when n=0.

The finite sum over k can be evaluated by means of the geometric progression. The result, according to formula 1.341.3 of I. S. Gradshteyn and I. M. Ryzhik, *Table of Integrals, Series, and Products* (Academic, New York, 1980) is:

$$\sum_{k=0}^{N} \cos\left[\frac{2\pi(n-m)k}{N} + \omega t - n\pi\left(\frac{z}{\ell} + \frac{N-1}{n}\right)\right] = \sin[(n-m)\pi]\csc\left[\frac{(n-m)\pi}{N}\right]\cos\left[\omega t - \frac{n\pi z}{\ell} - \frac{m\pi(N-1)}{N}\right] \quad (8)$$

The coefficient of the cosine term on the right-hand side of Equation (8) assumes its maximum value, N, when both m and (n−m)/N are integers. For n=m+jN, where j is an integer, the above sum equals N cos [ωt−nπ(z/l+1−(1/N))], as can be seen by directly inserting n=m+jN in the left-hand side of Equation (8). Performing the summation with respect to kin Equation (7) for an integral value of m, we therefore obtain:

$$W_{cv}(z,t) \simeq \frac{N}{m\pi}\sin\frac{m\pi}{N}\left\{\cos\left[\omega t - \frac{m\pi z}{\ell} - \frac{m\pi(N-1)}{N}\right] + \sum_{j\neq 0}\frac{1}{1+jN/m}\csc\left[\omega t - \frac{\pi z}{\ell}(m+jN) - \frac{m\pi(N-1)}{N}\right]\right\} \quad (9)$$

since only those terms of the infinite series survive for which n has the value m+jN with an j that ranges over all integers from −∞ to ∞.

In Equation (9), the summation has been broken out into two terms, namely a first term corresponding to j=0 and a second term corresponding to all other values of j. The parameter N/m, which signifies the number of electrodes within a wavelength of the polarization current wave, need not be large for the factor $(m\pi/N)^{-1}\sin(m\pi/N)$ to be close to unity. For example, this factor equals 0.9 even when N/m is only 4. Moreover, if the phase speed lω/(mπ) of the traveling polarization current wave that is associated with the l=0 term is only moderately superluminal, the phase speeds lω/(mπ|1+Nj/m|) of the polarization current waves described by all the other terms in the series would be subluminal. Not only would these other polarization current waves have amplitudes that are by the factor $|1+Nj/m|^{-1}$ smaller than that of the fundamental polarization current wave associated with l=0, but these other polarization current waves also would generate electromagnetic fields whose characteristics are different from those generated by the superluminally moving polarization current wave. Accordingly, for the fundamental Fourier component of the discretized travelling wave $W_{cv}(z, t)$ to be dominant and to have the intended superluminal speed, it may be preferable that an integral number, m, of its wavelengths fit inside the interval −l≤z≤l occupied by the dielectric radiator 212.

The electric polarization P that is generated by the array of electrode pairs 214, 216 described above has a distribution over the x-y cross-section of the dielectric radiator 212 whose details do not significantly affect the electromagnetic radiation emitted by the polarization current density j=∂P/∂t. If we denote this cross-sectional distribution by s(x, y), then P can be written as $$P_{cv}(x,t) = s(x,y)A(z)\cos\left[\omega\left(t - \frac{z}{u}\right)\right], \quad -\ell \le z \le \ell \quad (10)$$

in which a non-constant A(z) would describe a possible modulation of the amplitude of the propagating polarization current wave with the coordinate z along the dielectric radiator 212. Note that the phase speed u of this polarization current wave equals lω/(mπ) in the discretized version of $W_{cv}(z, t)$ set forth above in Equation (9).

The polarization current wave can be made to propagate at superluminal speeds. In particular, adjacent polarization elements 218 may be energized to oscillate out of phase with each other, so that there is a time difference Δt between the instants at which the oscillatory applied voltages attain maximum amplitude at adjacent polarization elements 218, as shown in FIG. 7. Parameters of the polarization current antenna 200 can be chosen such that the time interval Δt is less than the time taken by light in a vacuum to travel the distance Δl between the centers of adjacent polarization elements 218. The variation thus produced in the distribution pattern of the induced volume polarization current results in the propagation of this distribution pattern (i.e., a polarization current wave) along the length of the dielectric radiator 212 with the speed Δl/Δt. The phase difference between the oscillations of two adjacent polarization elements 218, ΔΦ, and the energizing time delay Δt are related by ΔΦ=2πvΔt, where v=ω/(2π) is the frequency of the oscillations of the signals applied to the upper electrodes 214. So, in the case of a dielectric radiator 212 that has N=72 polarization elements 218 (and hence N upper electrodes 214) and a distance between the centers of each polarization element 218 is Δl=1 cm, energizing the upper electrodes 214 with the phase difference ΔΦ=2mπ/N=2mπ/72 radians (=5m degrees) and the frequency v=2.5 GHz results in a sinusoidal polarization current wave that contains m wavelengths, and whose speed along the dielectric radiator 212 of length NΔl=2l=72 cm is given by u=Δl/Δt=2lv/m=$1.8\times10^{11}$/m cm/second. In this particular example, if m is set to less than 6 (i.e., the polarization current wave passes through less than six cycles as it propagates through the dielectric radiator 212) then the speed of the polarization current wave will exceed the speed of light in a vacuum.

As noted above, in order to strongly focus the received electromagnetic radiation in the time domain it is necessary that the polarization current wave travel with acceleration. When the polarization current antenna includes an arc-shaped dielectric radiator (e.g., a ring-shaped dielectric radiator), then the polarization current wave inherently has centripetal acceleration which allows for the desired focusing of the received electromagnetic radiation in the time domain. In contrast, when a linear dielectric radiator is used such as the dielectric radiator 212 of FIG. 6, no such inherent acceleration is present. Accordingly, with a linear polarization current antenna the excitation signal that is applied to the polarization devices may be designed to produce a polarization current waveform that exhibits acceleration.

According to some embodiments, the required acceleration may be created by inducing phase differences between the oscillations of adjacent polarization elements 218 of the polarization current antenna 200 that depend on their relative positions. In other words, the polarization current antenna 200 may be designed to generate a volume polarization current distribution pattern (i.e., polarization current wave) that is characterized as follows:

$$W(z,t)=\cos\,[\omega t-\psi(z)] \tag{11}$$

where $\psi(z)$ has a nonlinear dependence on z. This polarization current wave W(z, t) of Equation (11) differs from the polarization current wave $W_{cv}(z, t)$ of Equation (3) in that the polarization current wave $W_{cv}(z, t)$ of Equation (3) propagates at a constant speed u whereas the polarization current wave W(z, t) of Equation (11) propagates at a non-constant speed and hence has acceleration. The speed and acceleration of the surfaces of constant phase for the polarization current wave of Equation (11) (which correspond to the speed and acceleration of the polarization current wave) are given by $$\frac{dz}{dt}=\frac{\omega}{d\psi/dz}, \tag{12}$$

and $$\frac{d^2z}{dt^2}=-\frac{\omega^2 d^2\psi/dz^2}{(d\psi/dz)^3}$$

as can be seen by repeatedly differentiating $\omega t-\psi(z)$=constant with respect to t. The simplest motion for which the acceleration of these constant-phase surfaces vanishes at some point within the dielectric radiator 212 (e.g., at z=0) in the course of their propagation through the dielectric radiator 212 is described by a $\psi$ which makes the acceleration proportional to z:

$$\frac{d^2z}{dt^2}=-\omega_0^2 z \tag{13}$$

In other words, may be selected so that:

$$\frac{d^2\psi}{dz^2}+\left(\frac{\omega_0}{\omega}\right)^2 z\left(\frac{d\psi}{dz}\right)^3=0 \tag{14}$$

where $\omega_0$ is a positive constant with the dimension of an angular frequency. Equation (14) is a differential equation that can be solved to obtain the following two types of solutions $$\begin{bmatrix}\psi_{as}\\ \psi_{ash}\end{bmatrix}=\frac{\omega}{\omega_0}\begin{bmatrix}\sin^{-1}(\omega_0 z/u)\\ \sinh^{-1}(\omega_0 z/u)\end{bmatrix} \tag{15}$$

where u is a constant of integration. It can be seen from the first member of Equation (12) that the polarization current wave described by Equation (11) with $\psi=\psi_{as}$ and $\psi=\psi_{ash}$ have the speeds:

$$\frac{dz}{dt}=(u^2-\omega_0^2 z^2)^{1/2},\quad\text{and}\quad\frac{dz}{dt}=(u^2+\omega_0^2 z^2)^{1/2} \tag{16}$$

respectively, so that u represents the value of their speeds at the point z=0 where their acceleration vanishes. The polarization current waves described in Equation (11) that have the $\psi(z)$ function described by the two formulas of Equation (15) are referred to herein as polarization current waves that are accelerated by an "arcsin" acceleration scheme and an "arcsin h" acceleration scheme, respectively. Polarization current waves accelerated by the arcsin acceleration scheme will have a speed described by the first component of Equation (16), and polarization current waves accelerated by the arcsin h acceleration scheme will have a speed described by the second component of Equation (16). The arcsin and arcsin h acceleration schemes will now be discussed in more detail with reference to FIGS. 8-10.

Figure 8:
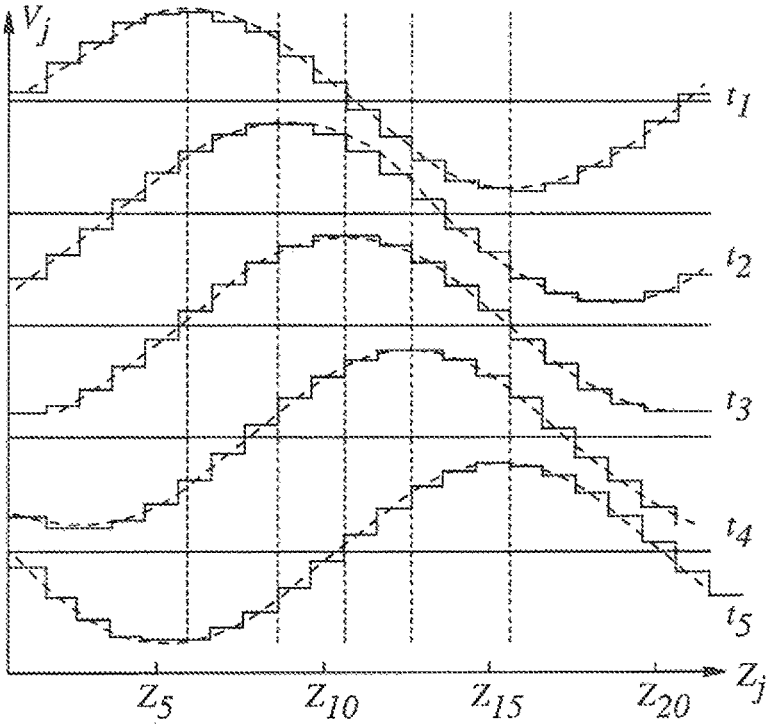
FIG. 8 is a graph illustrating the voltages that may be applied to the electrodes of a polarization current antenna when the polarization current antenna is excited according to an "arcsin h" acceleration scheme.
Figure 9:
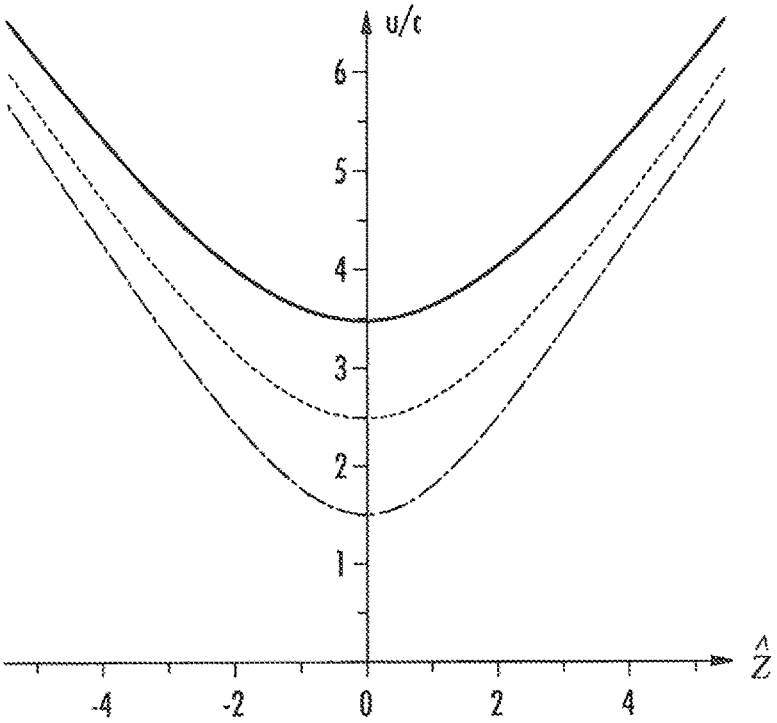
FIG. 9 is a plot showing the speed, normalized in units of the speed of light, of a polarization current wave as a function of position along a linear dielectric radiator of a polarization current antenna when the arcsin h acceleration scheme is used to excite the antenna.
Figure 10:
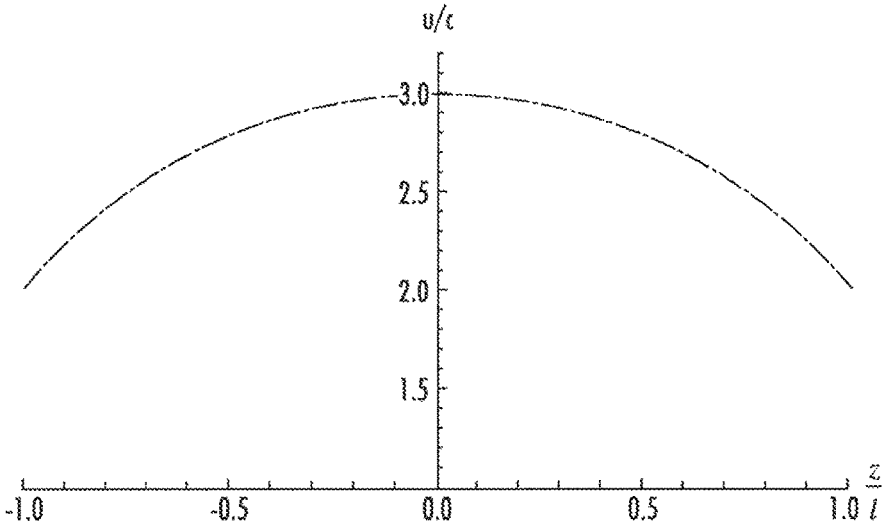
FIG. 10 is a plot showing the speed, normalized in units of the speed of light, of a polarization current wave as a function of position along a linear dielectric radiator of a polarization current antenna when an arcsin acceleration scheme is used to excite the antenna.

In particular, FIG. 8 illustrates the voltages $V_j$ that may be applied to, for example, the upper electrodes 214 of the first twenty consecutive polarization elements 218 of the polarization current antenna 200 when the polarization current antenna 200 is excited according to the arcsin h acceleration scheme. In FIG. 8, the five separate curves illustrate the voltages $V_j$ that are applied at five equally-spaced consecutive times ($t_1<t_2<t_3<t_4<t_5$). The vertical dotted lines designate the consecutive positions of the constant-phase surface at which $V_j$ is maximum. When the polarization current antenna 200 is excited according to the arcsin h acceleration scheme, then $V_j\propto\cos\,[\omega(t-\text{arcsin h}(\omega z_j/u)]$, as seen from Equations (11) and (15) above. FIG. 8 illustrates this graphically and the acceleration can be viewed in FIG. 8 by the non-constant distances between the dotted vertical lines. As noted above, the speed u=dz/dt of the constant-phase surface at which $V_j$ is maximum corresponds to the speed of the polarization current wave. FIG. 9 is a plot showing the speeds of several polarization current waves accelerated according to the arcsin h acceleration scheme as a function of position along the length of the dielectric radiator 212. In FIG. 9, speeds are plotted for three different polarization current waves that have different variable speeds u. In each case, the speed u is normalized by dividing by the speed of light. Similarly, FIG. 10 is a plot showing the normalized speed of the polarization current wave as a function of position along the dielectric radiator 212 when the arcsin acceleration scheme is used, where the speed is again normalized by dividing by the speed of light. The plot of FIG. 9 is generated based on the second member of Equation (16) above and the plot of FIG. 10 is based on the first member of Equation (16) above.

Figure 11:
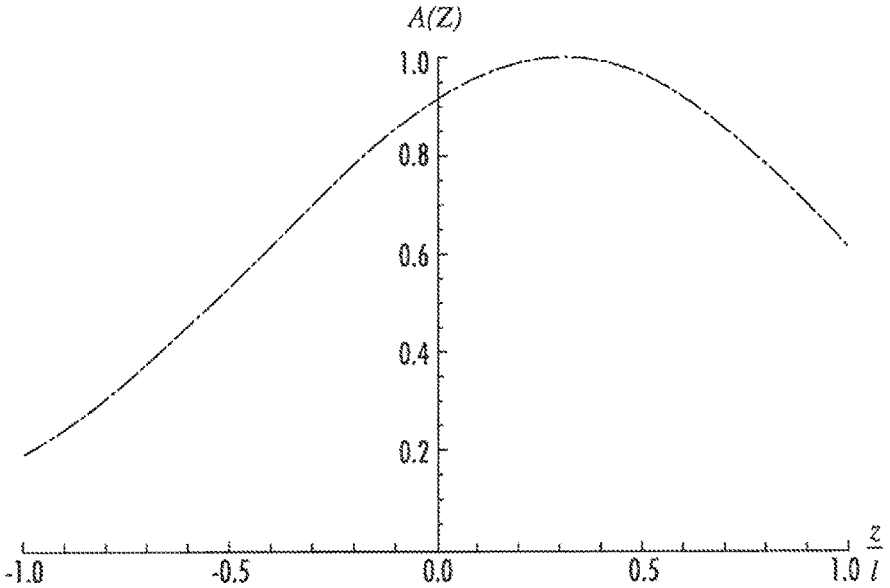
FIG. 11 is a plot of an offset Gaussian distribution which may be applied to a polarization current antenna as an amplitude function.

Referring again to Equations (11) and (15) above, the corresponding expressions for the electric polarizations associated with the arcsin and arcsin h acceleration schemes are:

$$\begin{bmatrix}P_{as}(x,t)\\ P_{ash}(x,t)\end{bmatrix}=s(x,y)A(z)\cos\left(\omega t-\begin{bmatrix}\psi_{as}(z)\\ \psi_{ash}(z)\end{bmatrix}\right) \tag{17}$$

where s(x, y) stands for the distribution of the polarization over an x-y cross section of the dielectric radiator 212, as in Equation (10) above. The amplitude function A(z) can have any form. In some embodiments, it may be advantageous that the amplitude function A(z) have a gradient at z=0 that is non-zero. In one example embodiment, the amplitude function A(z) can be a shifted version of a Gaussian distribution, as illustrated in FIG. 11.

Referring again to Equation (11), the polarization current waves generated using the arcsin and arcsin h acceleration schemes can be characterized as follows:

$$\begin{bmatrix} W_{as}(z,t) \\ W_{ash}(z,t) \end{bmatrix} = \cos\left(\omega t - \begin{bmatrix} \psi_{as}(z) \\ \psi_{ash}(z) \end{bmatrix}\right) \tag{18}$$

As described above with reference to Equation (4), the polarization current waves of Equation (18) can be experimentally implemented by approximating them with discrete distributions:

$$\begin{bmatrix} W_{as}(z,t) \\ W_{ash}(z,t) \end{bmatrix} \simeq \sum_{k=0}^{N-1} \prod \left(\frac{Nz}{2l} + \frac{N-1}{2} - k\right) \cos\left(\omega t - \begin{bmatrix} \psi_{as}^{d}(k) \\ \psi_{ash}^{d}(k) \end{bmatrix}\right) \tag{19}$$

where in Equation (19):

$$\begin{bmatrix} \psi_{as}^{d}(k) \\ \psi_{ash}^{d}(k) \end{bmatrix} = \frac{\omega}{\omega_0} \begin{bmatrix} \sin^{-1}\left(\frac{k}{N}\sin\frac{2\pi m\omega_0}{\omega}\right) \\ \sinh^{-1}\left(\frac{k}{N}\sinh\frac{2\pi m\omega_0}{\omega}\right) \end{bmatrix} \tag{20}$$

and m again denotes the number of wavelengths of the polarization current wave that are contained within the dielectric radiator 212 (i.e., in the range $-l \le z \le l$). In both cases in Equations (19) and (20), the phase difference between the first electrode for which $\psi_{as}^{d}=\psi_{ash}^{d}=0$ and the $N^{th}$ electrode for which $\psi_{as}^{d}=\psi_{ash}^{d}=2\pi m$ corresponds to m wavelengths.

Note that the discretized polarization current waves described by Equations (19) and (20) both reduce to the polarization current wave $W_{cz}(z, t)$ of Equation (7) at the limit $\omega_0 \to 0$ where the acceleration reduces to zero. In the case of the arcsin h acceleration scheme, for the speed at z=l to differ from the speed at z=0 (i.e., u) by a fraction f of u, we need to have $\omega_0=[f(2+f)]^{1/2}u/l$, as can be determined from Equation (16). In the example provided above, l=72 cm, $u=4\times10^{10}$ cm/second and v=2.5 GHz. For this case, $\omega_0/\omega$ is about 0.04 if f=½. It can be verified numerically that for such values of $\omega_0/\omega$ and $1 \le m \le 5$, the amplitudes of the fundamental terms in the Fourier decompositions (with respect to z) of the discretized versions of the polarization current waves generated using the arcsine and arcsin h acceleration schemes are maximized when m is an integer. Since the propagation speed of these polarization current waves is dependent on the location of each polarization current wave along the z-axis (i.e., its location within the dielectric radiator 212) while the oscillation frequency is fixed, the polarization current waves generated using the arcsin and arcsin h acceleration schemes have respective wavelengths that vary with z. However, even though the respective wavelengths are variable, m is still considered to be an integer so long as an integral number of the variable wavelengths fit into the segment $-l \le z \le l$ occupied by the dielectric radiator 212.

The speed u of the polarization current wave at z=0 (i.e., in the exact middle of the antenna 200), which exceeds the speed of light c, specifies a polar angle $\Theta_P$ relative to the z-axis:

$$\theta_P = \arccos(c/u) \tag{21}$$

Figure 12:
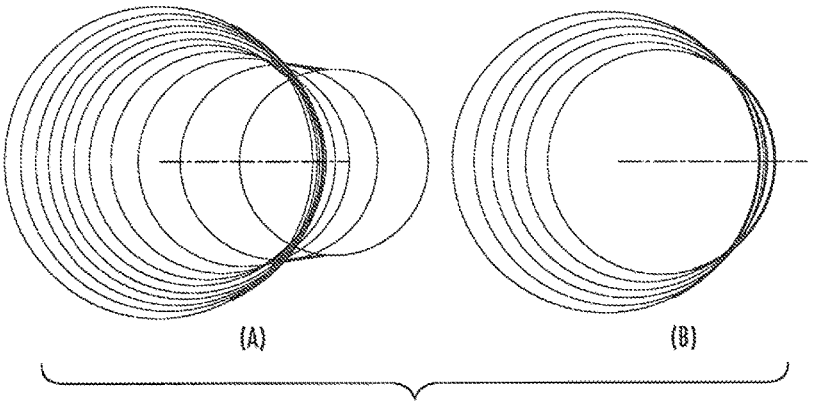
FIG. 12 is a perspective view that schematically illustrates the wave fronts emitted by a single volume element of a polarization current that is accelerated by the arcsin h acceleration scheme in two cases: (a) the case in which the distance that is traversed by the volume element during the emission of the shown wave fronts is comparable to the distance of the observation point from the source, and (b) the case in which the distance that is traversed by the volume element during the emission of the shown wave fronts is short compared to the distance of the observation point from the source.

The electromagnetic radiation emitted by the antenna 200 will have peak intensity at the polar angle $\Theta_P$. This can be seen by noting that the waves described by $P_{ash}$ in Equation (17), for instance, propagate in such a way that certain volume elements of the polarization distribution $P_{ash}$ approach the observer at $\Theta_P$=arccos(c/u), along the radiation direction, with the speed of light and zero acceleration at the retarded time. In the case of $P_{ash}$, these volume elements are located on the cross section of the dielectric radiator with the plane:

$$z = -\left(\frac{u^2}{c^2} - 1\right)\frac{l^2}{z_P} \tag{22}$$

where $z_P$ is the z coordinate of the observation point P on the cone $\Theta_P$=arccos(c/u). As a result, the electromagnetic waves emanating from these particular volume elements have an envelope that is cusped. This is shown graphically in FIG. 12. In particular, FIG. 12 schematically illustrates the wave fronts emitted by a single volume element of a polarization current wave that is accelerated by the arcsin h acceleration scheme in two cases: (a) the case in which the distance that is traversed by the volume element during the emission of the shown wave fronts, here designated by the horizontal bar-like line in the center of the drawing, is comparable to the distance of the observation point from the source, and (b) the case in which the distance that is traversed by the volume element during the emission of the shown wave fronts, here designated by the horizontal bar-like line in the center of the drawing, is short compared to the distance of the observation point from the source. In the examples of FIG. 12, u/c=1.01 and $\omega_0$=1. The cusped envelopes of the waves are shown by the heavier curves in the drawings. In the left hand drawing of FIG. 12, the wave fronts illustrated were emitted as the polarization current wave travelled from $-2 \le z \le 11$ (which is designated by the horizontal bar-like line in the center of the drawing line in the center of the drawing) and the wave fronts are shown at an observation time of $t_P=10/\omega$. In the right hand drawing of FIG. 12, the parameters are the same except that the wave fronts illustrated were emitted as the polarization current wave travelled from $-2 \le z \le 4$. Note that the two drawing have different scales.

It can be shown that the electromagnetic radiation emitted by the polarization current antenna 200, when the electrodes 214 thereof are excited according to the above-described arcsin or arcsin h acceleration schemes, has components that decay at a rate of $1/d^{2-\alpha}$ with $0<\alpha<1$ with a distance d from the antenna 200. In particular, by solving the Maxwell equations using the method described in the aforementioned European Patent No. 112578, we find that the higher-order focusing of the wave fronts at this cusp results in a lower decay rate ($\sim 1/d^{2-\alpha}$ with $0<\alpha<1$) of the radiation intensity with a distance d from the antenna 200. This lower decay rate of the intensity is accompanied by a temporal decrease in the radiation energy contained inside any closed surface, as is required by the law of conservation of energy.

Figure 17:
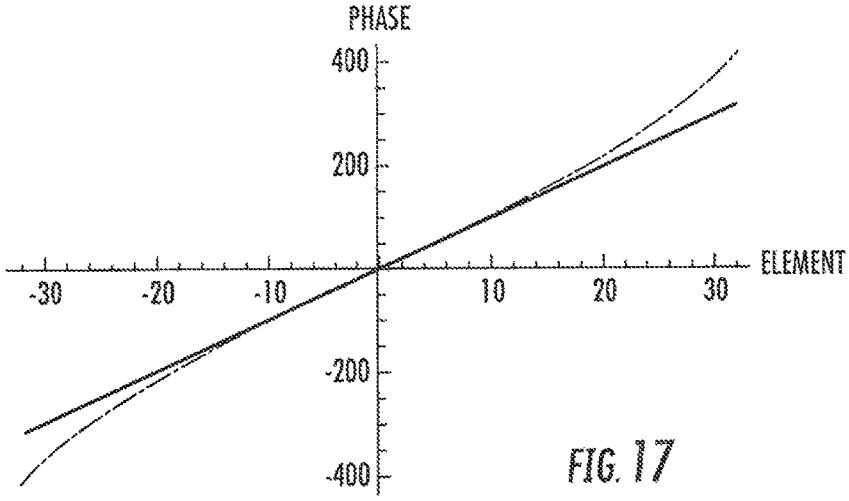
FIG. 17 is a graph illustrating an example phase profile that may be used to accelerate a polarization current wave according to the arcsin acceleration scheme.

FIG. 17 is a plot of the phase profile of an example embodiment of the arcsin acceleration scheme. In FIG. 17, the horizontal axis shows the position of each of sixty-four polarization elements of a polarization current antenna that is excited using the arcsin acceleration scheme, and the vertical axis show the corresponding applied phase in degrees. In the illustrated example, the polarization current antenna is designed and excited so that the polarization current wave has a speed that ranges from the speed of light (c) to 3c while traversing the first half of the dielectric radiator and a speed that varies from 3c to c while traversing the second half of the dielectric radiator. The straight line in FIG. 17 shows the phase profile corresponding to a polarization current wave that moves through the dielectric radiator with a constant speed of 3c for comparative purposes.

While the above-described arcsin and arcsin h acceleration schemes comprise two potential schemes for generating superluminal polarization current waves in, for example, a rectilinear polarization current antenna, it will be appreciated that other acceleration schemes may be used. For example, pursuant to further embodiments of the present invention, a so-called "elliptic" acceleration scheme may be used instead. When the elliptic acceleration scheme is used as the function ψ(z) in Equation (11), not only the acceleration of the constant-phase surfaces of the polarization wave W(z, t) which can be either positive or negative, but also the rate of change of this acceleration with respect to time vanishes at the midpoint z=0 of the dielectric radiator 212, i.e., such that $$\frac{d^2z}{dt^2} = \pm\frac{3u^2}{2\ell^3}z^2 \tag{23}$$

where u again stands for the speed of the polarization current wave at z=0 and the plus and minus signs correspond to a positive or negative acceleration, respectively. According to Equation (12), this can be achieved by requiring that ψv(z) satisfies:

$$\frac{d^2\psi}{dz^2} = \pm\frac{3u^2z^2}{2\ell^3\omega^2}\left(\frac{d\psi}{dz}\right)^3 = 0 \tag{24}$$

The solution to Equation (24) which vanishes when z=0 is given by:

$$\psi_e(z) = \pm\frac{\omega\ell}{3^{1/4}u}[F(\sigma, k) - F(\sigma|_{z=0}, k)] \tag{25}$$

where F(σ, k) is an elliptic integral of the first kind with the amplitude:

$$\sigma = \arccos\left(\frac{\sqrt{3} - 1 \mp z/\ell}{\sqrt{3} + 1 \pm z/\ell}\right) \tag{26}$$

and the parameter:

$$k = \frac{\sqrt{3} + 1}{2\sqrt{2}} \tag{27}$$

This result can be verified by substitution. The constant-phase surfaces of the polarization current wave that is accelerated using the elliptic scheme can be characterized as follows:

$$W_e(z,t) = \cos[\omega t - \psi_e(z)] \tag{28}$$

Figure 13A:
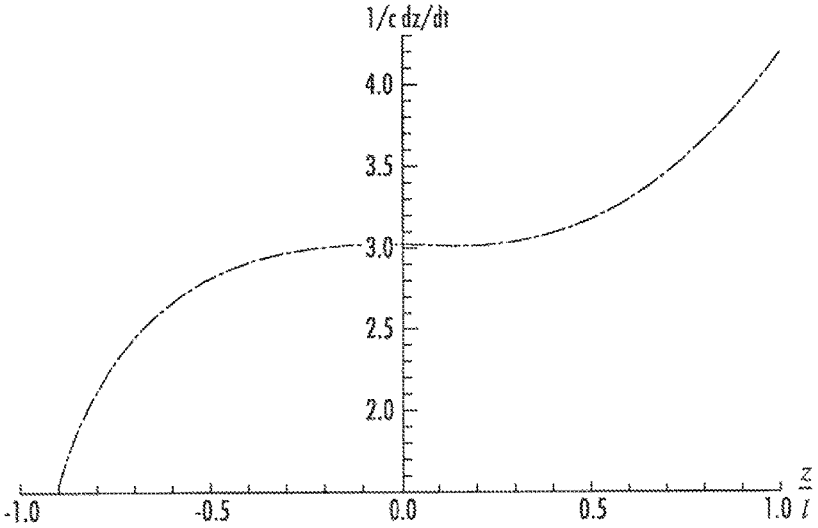
FIGS. 13A and 13B are graphs of the speed, in units of the speed of light, of a polarization current wave generated in a rectilinear polarization current antenna versus position within the dielectric radiator when the antenna is excited according to an elliptic acceleration scheme with a positive and negative acceleration, respectively.
Figure 13B:
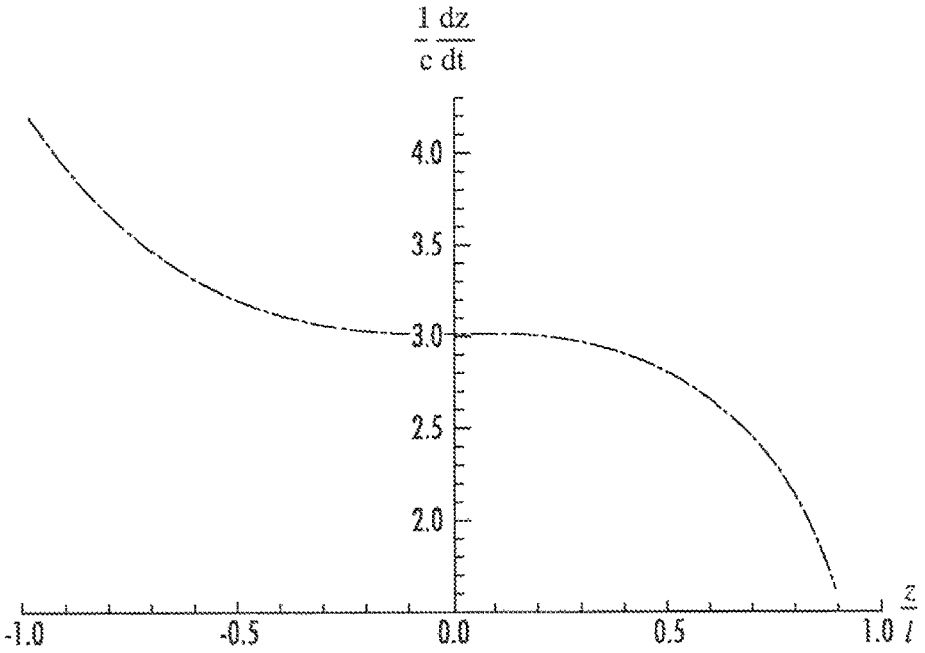

The speed of this polarization current wave versus position in the dielectric radiator 212 is plotted graphically in FIGS. 13A and 13B and can be characterized as follows:

$$\frac{dz}{dt} = u\left[1 \pm \left(\frac{z}{\ell}\right)^3\right]^{1/2} \tag{29}$$

As with the arcsin and arcsin h acceleration schemes discussed above, the speed u of the polarization current wave at z=0 specifies the polar angle $\Theta_P$=arccos(c/u) (relative to the elongated dielectric radiator 212 or, equivalently, relative to the z-axis) at which the intensity of the electromagnetic radiation peaks. The corresponding expression for the electric polarization generated in this scheme is $$P_\Theta(x,t) = s(x,y)A(z)\cos[\omega t - \psi_e(z)],\ -l \le z \le l \tag{30}$$

Figure 15:
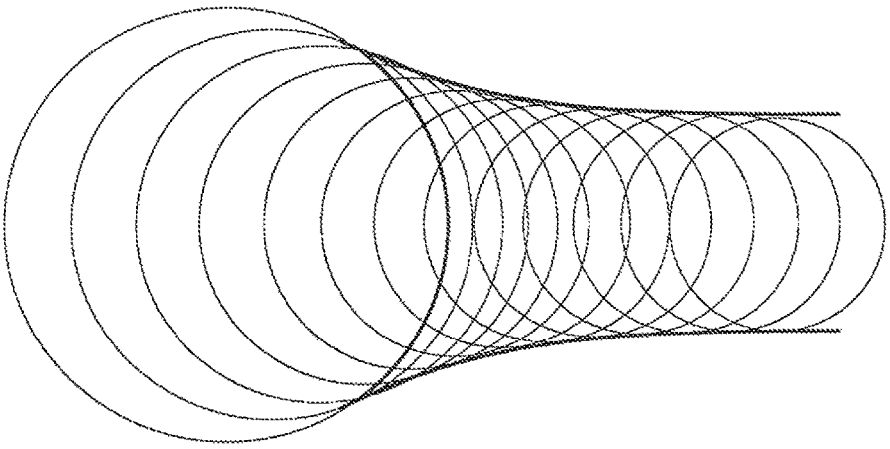
FIG. 15 is a perspective view that schematically illustrates a set of wave fronts emitted by a single volume element of the polarization current wave that is accelerated by the elliptic acceleration scheme and their envelope.

The volume elements located on the plane:

$$z = \mp\left[\frac{2}{3}\left(1 - \frac{c^2}{u^2}\right)\frac{\ell}{z_P}\right]^{1/2}\ell \tag{31}$$

within this source distribution approach the far-field observer at P with the speed of light and zero acceleration, and also with an acceleration that has a vanishing rate of change with the distance z along the dielectric radiator 212. This gives rise to an envelope of wave fronts whose x-y cross section has an inflection point and is expected to render the non-spherical decay of the radiation generated by $P_e$ even more pronounced. This is shown graphically in FIG. 15, which is a plot of the wave fronts of electromagnetic radiation emitted by a volume element of the polarization current when the antenna is excited according to the elliptic acceleration scheme. FIG. 15 also illustrates the cusped envelope of these wave fronts, which refers to the surface obtained by rotating the heavier (thicker) curve in FIG. 15 about the trajectory of the volume element. For an observation point at infinity, the inflection point on the cross section of this envelope coincides with its cusp.

Figure 14:
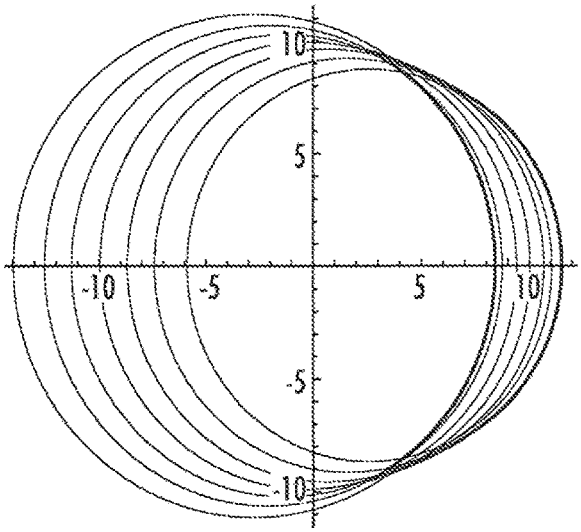
FIG. 14 is a perspective view that schematically illustrates a set of wave fronts emitted by a single volume element of the polarization current wave that is accelerated by the arcsin acceleration scheme and their envelope.

When the polarization current antenna is excited according to the arcsin, arcsin h and elliptic acceleration schemes spherical wave fronts are generated whose envelopes are cusped. If we denote the positions of the observation point and the source points by $x_P=(x_P, y_P, Z_P)$ and x=(x, y, z), respectively, then the envelopes of these wave fronts (which consist of two-dimensional surfaces of rotation) occur where the first derivatives with respect to z of the functions $$\begin{bmatrix} g_{as} \\ g_{ash} \\ g_e \end{bmatrix} = [(x - x_P)^2 + (y - y_P)^2 + (z - z_P)^2]^{1/2} + \begin{bmatrix} \psi_{as}(z) \\ \psi_{ash}(z) \\ \psi_e(z) \end{bmatrix} \tag{32}$$

vanish. The circular cusps of the envelopes occur where ∂g/∂z and $\partial^2 g/\partial z^2$ vanish simultaneously for each of the functions $g_{as}$, $g_{ash}$ and $g_e$. FIGS. 13-15 show the envelopes and their cusps for the arcsin, arcsin h and elliptic acceleration schemes, respectively. The collection of cusp curves that are generated by the constituent volume elements of the polarization current thus define what might loosely be termed a radiation beam, although its characteristics are distinct from those of conventionally produced beams. The radiation intensity decays non-spherically only along the propagating bundle of cusp curves embodying this radiation beam. Because one of the dimensions of the volume occupied by the bundle of cusps in question does not change proportionately to the distance d of the observation point from the antenna as the cusps propagate, the beamwidth of the non-spherically decaying radiation correspondingly decreases as $1/d^{\alpha}$ with $0<\alpha<2$.

In addition to a dielectric radiator and a plurality of polarization devices, the polarization current antennas according to embodiments of the present invention may include a feed network that is used to energize the polarization devices of the polarization elements progressively with a constant or non-constant time delay interval. In some embodiments, the feed network may be a passive feed network. The polarization devices may comprise, for example, a plurality of electrodes that extend along one side of the dielectric radiator and a ground plane that is coupled on the other side of the dielectric radiator opposite the electrodes. The passive feed network is coupled to the electrodes. The passive feed network receives a modulated RF signal and applies the RF signal according to power and phase relationships as set forth in an excitation profile. The excitation profile is selected such that the polarization current wave propagates along the dielectric radiator.

In some embodiments, the polarization current antenna may be a linear antenna having a linear dielectric radiator with a rectangular cross-section, as shown in FIGS. 6 and 6A above. An example of a linear polarization current antenna 500 that includes such a passive feed network 550 is schematically illustrated in FIG. 16.

Figure 16:
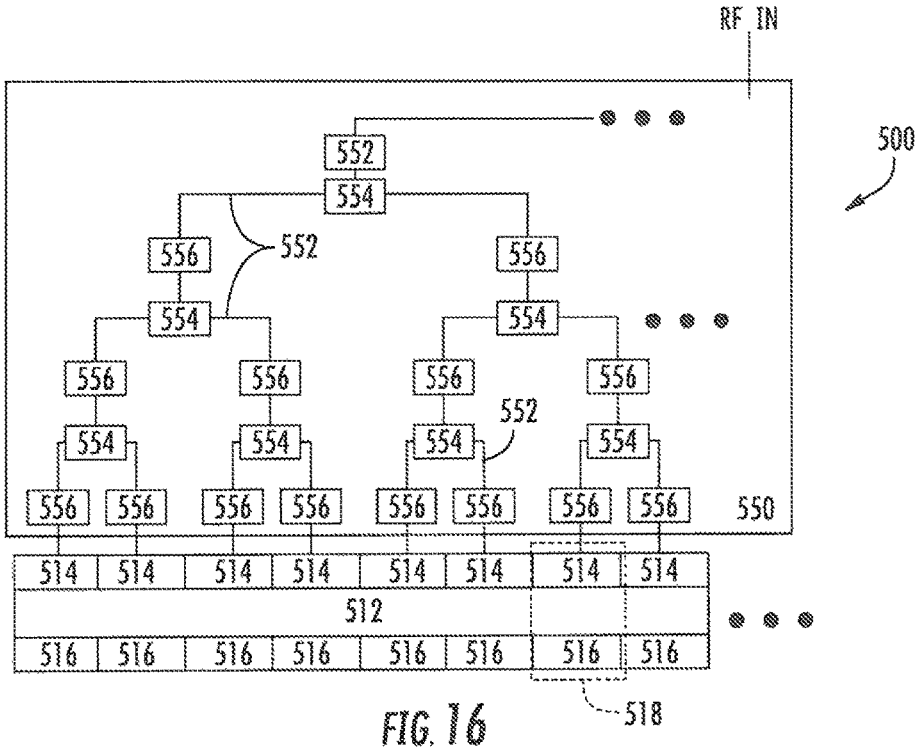
FIG. 16 is a schematic layout view of a portion of a feed network of a polarization current antenna according to certain embodiments of the present invention.

Referring to FIG. 16, the linear polarization current antenna 500 may include a plurality of upper electrodes 514, a plurality of lower electrodes 516 and a dielectric radiator 512. Each pair of an upper electrode 514, a lower electrode 516 and a portion of the dielectric radiator 512 therebetween form a polarization element 518. In FIG. 16, only eight of the polarization elements 518 are shown, and only the portion of the feed network 550 that feeds these eight polarization elements 518 is shown to simplify the drawing.

An input RF IN to the passive feed network 550 may be coupled to, for example, a power amplifier, or other RF source. The passive feed network 550 receives a modulated RF signal at this input that is to be transmitted by the polarization current antenna 500 that oscillates at a frequency $v=\omega/2\pi$. The feed network 550 may have a plurality of outputs. Each output may be coupled to an individual polarization device, which in the example of FIG. 16 are upper electrodes 514. The feed network 550 may apply the modulated RF signal to the upper electrodes 514 according to power and phase relationships that are set forth in an excitation profile. While not shown in FIG. 16, alternatively, one or more outputs of the feed network 550 may be coupled to a sub-array of two or more polarization devices. The terms "input" and "output" refer to the transmit direction of operation.

The feed network 550 may comprise, for example, a series of conductive paths 552, power divider elements 554 (which, may, for example, comprise circuit elements, RF elements or branches along conductive paths) that divide the modulated RF signal into a plurality of sub-components that are used to excite the electrodes 514, and phase delay elements 556. The magnitude of each sub-component may be set by the power dividers 554, which may divide the power of the modulated RF signal received at the inputs thereof either equally or non-equally. The power dividers 554 may be used to create an amplitude distribution with respect to the signals supplied to the polarization devices. The phase of each sub-component may be set by phase delay elements 556. In some embodiments, the phase delay elements 556 may be the lengths of the conductive paths that connect each upper electrode 514 to the input of the passive feed network 550 (i.e., different conductive paths may have different lengths to create desired phase delays between the conductive paths that feed adjacent polarization elements 518). In other embodiments, the phase delay elements 556 may be variable phase shifters. Other implementations are also possible (e.g., positioning materials having different dielectric constants adjacent different transmission paths to effect the delays on different transmission paths).

In one example, the feed network 550 may be fabricated on a printed circuit board. The feed network 550 may have, for example, a single input port and N output ports where N is equal to the number of polarization devices. The input port is coupled to a tree structure of power dividers and traces that act as transmission lines for signals that are propagated through the feed network. The lengths of the traces act as phase delay elements 556 and are selected to impart a desired time delay (phase shift) to the portion of the input signal that is provided to each respective output port. The power dividers 554 are selected to impart a desired power distribution across the output ports. The power distribution may be constant, tapered, or have some other suitable power distribution. For example, in on embodiment the power dividers 554 may be configured to impart the power distribution shown in FIG. 11 across the output ports (and hence to the polarization devices).

In one example embodiment, the feed network 550 distributes this RF signal to the upper electrodes 514 of polarization current antenna 500 with a phase that has the dependence $\arcsin h(\omega z_j/u)$ on the positions $z_j$ of the centers of the electrodes 514, where j=1, 2, . . . , N. As described above, such a feed network generates a polarization current wave that propagates through the dielectric radiator 512 along the z-axis smoothly when $N \gg \omega l/(\pi u)$, i.e., when the number of polarization devices within a wavelength $2\pi u/\omega$ of the resulting polarization current wave sufficiently exceeds unity. If the polarization devices in addition oscillate in phase with a second frequency $\Omega/2\pi$, then the generated polarization current wave will have the form:

$$P(x,y,z,t)=s(x,y)\cos(\Omega t)\cos\left[\omega t-\psi_{ash}(z)\right] \tag{33}$$

where s(x, y) is a vector field that vanishes outside a finite region of the (x, y) plane representing the cross-section of the dielectric radiator 512. In other embodiments, the feed network 550 may distribute the RF signal to the upper electrodes 514 of polarization current antenna 500 with a phase that has the dependence $\arcsin(\omega z_j/u)$ on the positions $z_j$ of the centers of the electrodes 514. In still other embodiments, the feed network 550 may distribute the RF signal to the upper electrodes 514 of polarization current antenna 500 with a phase that has the dependence on the elliptic function set forth at Equations (25) through (27) above on the positions $z_j$ of the centers of the electrodes 514.

The polarization current antenna 500 and the feed network 550 can be designed to produce a polarization current wave that travels faster than the speed of light. For example, consider a simplified, illustrative example where the polarization current antenna 500 has a rectilinear shape and includes thirty upper electrodes 514, where the centers of the upper electrodes 514 are separated by one centimeter. In this example, the dielectric radiator 512 is thirty centimeters long. As the speed of light in a vacuum is approximately $3.0\times10^{8}$ m/s, the time it would take for light to travel from one end of the dielectric radiator 512 to the other in a vacuum would be $10^{-9}$ seconds, or one nanosecond. If the upper electrodes 514 are energized at time delay intervals of 100 picoseconds, the polarization current wave would take three nanoseconds to propagate through the length of the dielectric radiator 512, which is slower than it would take light to travel the length of the dielectric radiator 512. If, on the other hand, the time delay interval was reduced from 100 picoseconds to 10 picoseconds, the polarization current wave would take three hundred picoseconds to propagate across the length of the dielectric radiator 512, which is less time than it would take for light to travel the same distance. Thus, it can be seen that the excitation profile may be used to set whether a polarization current wave travels with superluminal or non-superluminal speeds through the dielectric radiator 512.

In preparing an excitation profile, the designer may vary: the driving frequency $\omega$, and the phase difference between neighboring electrodes $\Delta\Phi$, and the electrode separation, $\Delta l$. The driving frequency $\omega$ is typically established by the frequency of the signal that is to be transmitted, and hence in many applications may be fixed (e.g., for cellular communications, antennas are typically designed to transmit and receive within a pre-defined frequency band). The phase differences between neighboring electrodes (or other polarization devices) may be set by the phase adjustment mechanisms in the feed network. The electrode separation may be set by the design of the polarization current antenna. By adjusting these variables, the speed at which the volume displacement current distribution propagates, u, may be expressed as $u=\omega\ \Delta l/\Delta\Phi$.

By way of example, if the electrodes are separated by $\Delta l=0.05$ m, the feed network is set to impart of phase difference $\Delta\Phi=\pi/20$ (or 9 degrees) between adjacent upper electrodes 514, and the frequency of the RF driving signal is $\omega=2\pi*300$ MHz, the polarization current wave will propagate through the dielectric radiator 512 at a speed of $u=3\times 10^8$ m/s, which is approximately equal to the speed of light. Increasing the separation between the upper electrodes 514, or decreasing the phase difference, would cause the polarization current wave to propagate at superluminal speeds.

In the above example, the feed network energizes the upper electrodes 514 progressively with a constant time delay interval, which produces a polarization current wave that moves with a constant velocity. However, as discussed above, in some situations, it may be desirable to generate a polarization current wave that moves with acceleration to achieve a stronger focusing of the emitted electromagnetic radiation at a remote observation point. As described above, this may be accomplished by using a feed network that energizes the polarization devices according to an excitation profile that causes the polarization current wave to accelerate during at least a portion of the time as it propagates through the dielectric radiator. This acceleration is easily achieved by, for example, shortening the time delay intervals between at least some adjacent polarization devices relative to the time intervals between other adjacent polarization devices. For example, the time delay interval between polarization devices may be progressively reduced across at least a portion of the polarization current antenna in some embodiments. By progressively reducing the time interval between adjacent polarization devices, while keeping the distance between the centers of the adjacent polarization devices equally spaced, the polarization current wave will accelerate as it propagates through the dielectric radiator.

As discussed above, in some embodiments, the polarization current wave may be made to accelerate according to the arcsin, arcsin h or elliptic acceleration schemes. As shown in FIG. 9, when the arcsin h acceleration scheme is used, the polarization current wave may be made to gradually decelerate and to then gradually accelerate as it propagates through the dielectric radiator. As shown in FIG. 10, when the arcsin h acceleration scheme is used, the polarization current wave may be made to gradually accelerate and to then gradually decelerate as it propagates through the dielectric radiator. As shown in FIG. 13A, when the elliptic acceleration scheme with positive acceleration is used, the polarization current wave may be made to gradually accelerate at a decreasing rate until the acceleration reaches zero and then to accelerate at an increasing rate as it propagates through the dielectric radiator. As shown in FIG. 13B, when the elliptic acceleration scheme with negative acceleration is used, the speed of the polarization current wave may be made to gradually decelerate at a decreasing rate until the acceleration reaches zero and then to decelerate at an increasing rate as it propagates through the dielectric radiator.

In other embodiments, acceleration profiles may be used that generate polarization current waves that have the following characteristics:

- an increasing speed over a first portion of the dielectric radiator and a decreasing speed over the remainder of the dielectric radiator;
- a decreasing speed over a first portion of the dielectric radiator and an increasing speed over the remainder of the dielectric radiator;
- a speed that is always increasing along the length of the dielectric radiator;
- a speed that is always decreasing along the length of the dielectric radiator; and
- any of the above further including one or more sections where the speed remains constant.

It should be noted that the polarization current antennas discussed above operate to generate a polarization current wave that travels through a dielectric radiator. It will be appreciated that the electrodes are repeatedly excited in order to repeatedly generate polarization current waves that travel from a first end of the dielectric radiator 212 to a second opposed end thereof. Each polarization element 218 may be excited in turn with a constant or non-constant time delay interval. Eventually the last polarization element 218 on the second end of the polarization current antenna 200 will be reached. When this occurs, the first polarization element 218 may then be excited as if it were at the next polarization element 218 in sequence.

It should also be noted that while embodiments of the present invention are primarily discussed above with reference to polarization current antennas that include a dielectric radiator in the form of a rectilinear strip, the present invention is not limited to such dielectric radiators. It is contemplated that polarization devices may be embedded in, or otherwise coupled to, dielectric solids having shapes other than strips of dielectric material.

The number of polarization devices included in the polarization current antennas according to embodiments of the present invention may vary. Thus, it will be appreciated that the numbers of polarization devices shown in the embodiments herein are merely examples.

While example embodiments of the present invention have been described above, it will be appreciated that many modifications may be made to these example embodiments without departing from the scope of the present invention.

While the present invention has been described above primarily with reference to the accompanying drawings, it will be appreciated that the invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. As one specific example, various features of the communications jacks of the present invention are described as being, for example, adjacent a top surface of a dielectric radiator. It will be appreciated that if elements are adjacent a bottom surface of a dielectric radiator, they will be located adjacent the top surface if the device is rotated 180 degrees. Thus, the term "top surface" can refer to either the top surface or the bottom surface as the difference is a mere matter of orientation.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Herein, the terms "on," "attached," "connected," "contacting," "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A polarization current antenna, comprising:

a dielectric radiator that extends along a z-axis;

a plurality of polarization devices that are configured to polarize respective portions of the dielectric radiator that lie along the z-axis from z equals −l to z equals l;

a feed network that is configured to excite the polarization devices using a received radio frequency ("RF") signal to generate a polarization current wave that propagates in the z-axis direction through the dielectric radiator; and wherein the polarization current antenna is configured so that as the generated polarization current wave propagates through the dielectric radiator from z equals −l to z equals l, the dielectric radiator contains a number of wavelengths of the polarization current wave that is within 20% of an integer number of wavelengths, wherein the polarization current wave is configured to only propagate through the dielectric radiator from z equals −l to z equals l.

2. The polarization current antenna of claim 1, wherein the polarization current antenna is configured so that as the generated polarization current wave propagates through the dielectric radiator from z equals −l to z equals l, the dielectric radiator contains a number of wavelengths of the polarization current wave that is within 10% of an integer number of wavelengths.

3. The polarization current antenna of claim 1, wherein the polarization current antenna is configured so that as the generated polarization current wave propagates through the dielectric radiator from z equals −l to z equals l, the dielectric radiator contains a number of wavelengths of the polarization current wave that is within 5% of an integer number of wavelengths.

4. The polarization current antenna of claim 1, wherein the polarization current antenna is configured so that as the generated polarization current wave propagates through the dielectric radiator from z equals −l to z equals l, the dielectric radiator contains a number of wavelengths of the polarization current wave that is approximately an integer number of wavelengths.

5. The polarization current antenna of claim 1, wherein the generated polarization current wave propagates through the dielectric radiator, with acceleration, at one of a first speed of $dz/dt=(u^2+\omega_0^2z^2)^{1/2}$, a second speed of $dz/dt=(u^2-\omega_0^2z^2)^{1/2}$ or a third speed of $dz/dt=u[1+(z/l)^3]^{1/2}$, where z is the position of the polarization current wave on the z-axis, u is the speed of the polarization current wave at a point where the acceleration is equal to zero and $\omega_0$ is a positive constant with the dimension of an angular frequency.

6. The polarization current antenna of claim 1, wherein the polarization devices are configured to generate the polarization current wave so that it is a superposition of at least one superluminal polarization current wave that propagates through the dielectric radiator at a speed that exceeds the speed of light in a vacuum and a plurality of subluminal polarization current waves that propagate through the dielectric radiator at speeds that are less than the speed of light in a vacuum, wherein an amplitude of the at least one superluminal polarization current wave is greater than respective amplitudes of the plurality of subluminal polarization current waves.

7. The polarization current antenna of claim 6, wherein the speed of the at least one superluminal polarization current wave is less than five times the speed of light.

8. The polarization current antenna of claim 1, wherein the polarization current antenna is configured to emit electromagnetic radiation that decays at a rate of $1/d^{2-\alpha}$ where $0<\alpha<1$ at a distance d from the polarization current antenna.

9. The polarization current antenna of claim 1, wherein an amplitude function is applied to the RF signal in the feed network to excite at least some of the polarization devices with different amplitude signals.

10. The polarization current antenna of claim 9, wherein the amplitude function has a non-zero gradient at a midpoint along the length of the dielectric radiator.

11. The polarization current antenna of claim 1, wherein the feed network is configured so that the polarization current wave propagates with a non-zero acceleration for at least some values of z in the range of −l to l, and so that a rate of change of the acceleration of the polarization current wave with respect to time vanishes at a value of z equal to zero.

12. A polarization current antenna, comprising:

a dielectric radiator that extends along a z-axis; and a plurality of polarization devices that are positioned adjacent the dielectric radiator along the z-axis that are configured to polarize respective portions of the dielectric radiator that lie along the z-axis from z equals −l to z equals l; and a feed network that is configured to excite the polarization devices using a received radio frequency ("RF") signal to generate a polarization current wave that propagates in the z-axis direction through the dielectric radiator with non-zero acceleration, wherein the generated polarization current wave is a superposition of a plurality of polarization current waves, and wherein only one of the plurality of polarization current waves travels at a speed that exceeds the speed of light in a vacuum.

13. The polarization current antenna of claim 12, wherein the one of the plurality of polarization current waves that travels at the speed that exceeds the speed of light has the largest amplitude of the plurality of polarization current waves.

14. The polarization current antenna of claim 12, wherein the speed of the one of the plurality of polarization current waves that travels at the speed that exceeds the speed of light is less than five times the speed of light.

15. The polarization current antenna of claim 12, wherein the amplitude of the one of the plurality of polarization current waves that travels at the speed that exceeds the speed of light exceeds respective amplitudes of the other of the plurality of polarization current waves by a factor of $|1+Nj/m|^{-1}$, where N is the number of polarization devices and m is the number of wavelengths of the polarization current wave that fit into the dielectric radiator between z equals −l to z equals l, and j is a positive integer.

16. The polarization current antenna of claim 15, wherein the number of polarization devices divided by m is at least four.

17. The polarization current antenna of claim 12, wherein the number of wavelengths of the polarization current wave that fit into the dielectric radiator between z equals −l to z equals l is substantially an integer.

18. The polarization current antenna of claim 12, wherein an amplitude function is applied to the RF signal in the feed network to excite at least some of the polarization devices with different amplitude signals.

19. The polarization current antenna of claim 12, wherein the feed network is configured so that a rate of change of the acceleration of the polarization current wave with respect to time vanishes at a value of z equal to zero.

20. A polarization current antenna, comprising:

a dielectric radiator that extends along a z-axis;

a plurality of polarization devices that are positioned adjacent the dielectric radiator along the z-axis that are configured to polarize respective portions of the dielectric radiator that lie along the z-axis from z equals −l to z equals l; and a feed network that is configured to excite the polarization devices to generate a volume polarization current distribution pattern that propagates in the z-axis direction through the dielectric radiator with a non-zero acceleration for at least some values of z, and so that a rate of change of the acceleration of the polarization current distribution pattern with respect to time vanishes at a value of z equal to zero, wherein the generated volume polarization current distribution pattern is a superposition of at least one superluminal volume polarization current distribution pattern that propagates through the dielectric radiator at a speed that exceeds the speed of light in a vacuum and a plurality of subluminal volume polarization current distribution patterns that propagate through the dielectric radiator at speeds that are less than the speed of light in a vacuum, wherein an amplitude of the at least one superluminal volume polarization current distribution pattern is greater than respective amplitudes of the plurality of subluminal volume polarization current distribution patterns.

21. The polarization current antenna of claim 20, wherein the generated volume polarization current distribution pattern comprises a generated polarization current wave, and wherein the polarization current antenna is configured so that the number of wavelengths of the generated polarization current wave that fit into the dielectric radiator between z equals −l to z equals l, is approximately an integer number of wavelengths.

22. The polarization current antenna of claim 20, wherein the at least one superluminal volume polarization current distribution pattern is the only one of the volume polarization current distribution patterns that propagates through the dielectric radiator at a speed that exceeds the speed of light.

* * * * *